US007753753B2

(12) United States Patent
Payne et al.

(10) Patent No.: US 7,753,753 B2
(45) Date of Patent: Jul. 13, 2010

(54) PLAYSETS WITH POP-UP STRUCTURES

(75) Inventors: Julian Payne, Los Angeles, CA (US); Kwun Chung Mo, Shatin (HK); Chung Chi Cheung, Maonsban (HK); Kit Hong Lau, Wan Chai (HK)

(73) Assignee: Mattel, Inc., El Segundo, CA (US)

( * ) Notice: Subject to any disclaimer, the term of this patent is extended or adjusted under 35 U.S.C. 154(b) by 622 days.

(21) Appl. No.: 11/811,884

(22) Filed: Jun. 11, 2007

(65) Prior Publication Data

US 2008/0081536 A1 Apr. 3, 2008

Related U.S. Application Data

(63) Continuation-in-part of application No. 11/446,404, filed on Jun. 2, 2006, now Pat. No. 7,618,301.

(60) Provisional application No. 60/812,329, filed on Jun. 9, 2006.

(51) Int. Cl.
*A63H 33/04* (2006.01)
*A63H 33/00* (2006.01)

(52) U.S. Cl. ..... 446/75; 446/478

(58) Field of Classification Search ..... 446/71–75, 446/476–478, 487, 486
See application file for complete search history.

(56) References Cited

U.S. PATENT DOCUMENTS

| | | | |
|---|---|---|---|
| 243,873 | A | 7/1881 | Dom et al. |
| 565,450 | A | 8/1896 | Gibson |
| 930,108 | A | 8/1909 | Walcutt |
| 953,168 | A | 3/1910 | Hamilton |
| 990,918 | A | 5/1911 | Stadler |
| 1,008,195 | A | 11/1911 | Prichard |
| 1,258,788 | A | 3/1918 | Koch |
| 1,430,778 | A | 10/1922 | Williams |
| 1,549,610 | A | 8/1925 | Reisz |
| 1,551,666 | A | 9/1925 | Jensen et al. |
| 1,819,932 | A | 8/1931 | Walden |
| 1,841,041 | A | 1/1932 | Lowenstein |
| 1,844,816 | A | 2/1932 | Brown |
| 1,870,395 | A | 8/1932 | Zarin |

(Continued)

FOREIGN PATENT DOCUMENTS

| | | | |
|---|---|---|---|
| EP | 555188 | A1 | 8/1993 |

(Continued)

OTHER PUBLICATIONS

PCT International Search Report and Written Opinion for PCT/US06/21696.

(Continued)

*Primary Examiner*—Kien T Nguyen
(74) *Attorney, Agent, or Firm*—Kolisch Hartwell, P.C.

(57) ABSTRACT

Playsets are disclosed. The playsets may include a support surface and a pop-up structure. The pop-up structure may be adapted to be selectively transitioned between a stowed configuration and a deployed configuration. In the stowed configuration the pop-up structure may be collapsed and may extend along the support surface. In the deployed configuration the pop-up structure may stand substantially transverse to the support surface.

21 Claims, 35 Drawing Sheets

U.S. PATENT DOCUMENTS 1,914,116 A 6/1933 Ford
1,992,618 A 2/1935 Jeffreys
2,148,279 A 2/1939 Sandberg
2,221,267 A 11/1940 Robertson
2,234,739 A 3/1941 Murrell
2,458,879 A 1/1949 Schenk
2,475,471 A 7/1949 Brown et al.
2,544,783 A 3/1951 Freedman et al.
2,648,847 A 8/1953 Crowder
2,735,109 A 2/1956 Feldman
2,837,863 A 6/1958 Duvall
2,872,753 A 2/1959 Fenton
2,992,598 A 7/1961 Einfalt
3,048,941 A 8/1962 Shaw
3,108,398 A 10/1963 Einfalt
3,182,420 A 5/1965 Bender
3,228,139 A 1/1966 Lohnes
RE26,642 E 8/1969 Bender
3,629,875 A 12/1971 Dow et al.
3,789,522 A * 2/1974 Moore ..... 434/433
D233,458 S 10/1974 Relling
3,880,429 A 4/1975 Blumenaus
4,030,234 A 6/1977 Allen et al.
4,030,235 A 6/1977 Terzian et al.
4,067,137 A 1/1978 Korthase
4,070,789 A 1/1978 Levenson
4,130,284 A 12/1978 Fuks
4,139,967 A 2/1979 Kuna et al.
4,146,983 A 4/1979 Penick et al.
4,165,579 A 8/1979 Chase
D254,982 S 5/1980 Fratarcangeli
4,212,231 A 7/1980 Penick et al.
D258,323 S 2/1981 Lewis
4,254,576 A 3/1981 Matsumoto et al.
4,321,708 A 3/1982 Troiano
4,337,589 A 7/1982 Volkert et al.
4,349,973 A 9/1982 Penick et al.
4,349,983 A 9/1982 Kilroy et al.
4,365,438 A 12/1982 Nelson
D267,570 S 1/1983 Argandona
D269,360 S 6/1983 Ng
4,433,504 A 2/1984 Terui
4,468,020 A 8/1984 Wallace
4,536,162 A 8/1985 Ace, Jr. et al.
D282,385 S 1/1986 Argandona
4,575,348 A 3/1986 Wiggs et al.
4,581,904 A 4/1986 Lehmann et al.
D284,328 S 6/1986 Bieber
4,592,573 A 6/1986 Crowell
D288,453 S 2/1987 Takasaka et al.
4,657,612 A 4/1987 Schoenleber et al.
4,661,080 A 4/1987 Goldstein et al.
4,685,728 A 8/1987 Rebollo
4,712,673 A 12/1987 Moore
4,774,780 A 10/1988 Crowell
4,793,006 A 12/1988 Dawson
D303,407 S 9/1989 Mazzocco
4,883,443 A 11/1989 Chase
4,898,404 A 2/1990 Babcock
4,910,899 A 3/1990 Alperin
4,937,207 A 6/1990 Simmell et al.
4,946,413 A 8/1990 Lehmann et al.
4,961,716 A 10/1990 Hippely et al.
4,964,249 A 10/1990 Payne
4,985,935 A 1/1991 Hur
5,004,445 A 4/1991 Coleman
5,013,278 A 5/1991 Dixon et al.
5,019,010 A 5/1991 Nikaido et al.
5,022,681 A 6/1991 Penick
5,049,078 A 9/1991 Thomsen
5,096,204 A 3/1992 Lippman
5,104,124 A 4/1992 Bernard et al.
5,213,507 A 5/1993 Ozrovitz
5,259,133 A 11/1993 Burtch
5,293,706 A 3/1994 Wood
5,317,823 A 6/1994 Brunt, II
5,356,155 A 10/1994 Gross
5,358,252 A 10/1994 McPhaul
5,360,028 A 11/1994 Jasin
5,452,846 A 9/1995 Myers
D366,290 S 1/1996 Dieudonne
5,480,335 A 1/1996 Caveza
5,525,088 A 6/1996 Mayne
5,542,870 A 8/1996 Westersund
5,562,520 A 10/1996 Prindonoff et al.
5,613,612 A 3/1997 Davault
D383,507 S 9/1997 Bro et al.
5,681,199 A 10/1997 Morris
5,682,999 A 11/1997 Larson
5,738,221 A 4/1998 Van Witt et al.
D394,476 S 5/1998 Blumenthal
5,758,777 A 6/1998 Dods
5,820,436 A 10/1998 Pohlman
5,830,033 A 11/1998 Piron
5,839,937 A 11/1998 Thomas
5,864,973 A 2/1999 Cole
5,868,599 A 2/1999 Kaufman
5,931,099 A 8/1999 Bruner et al.
5,933,989 A 8/1999 Volkert et al.
5,943,800 A 8/1999 Rose
5,961,149 A 10/1999 Hunt
6,099,380 A 8/2000 Rasmussen
6,138,701 A 10/2000 Zheng
6,146,238 A 11/2000 Daiber
6,199,308 B1 3/2001 Westendorp
6,203,017 B1 3/2001 Schultz
6,283,819 B1 9/2001 Polinger et al.
6,311,142 B1 10/2001 Glassner
6,386,370 B1 5/2002 Wigton et al.
6,554,685 B2 4/2003 Lish
6,572,436 B1 6/2003 So
6,684,894 B2 2/2004 Zheng
6,725,588 B1 4/2004 Swoboda
6,752,164 B1 6/2004 Park
6,871,853 B2 3/2005 Bedford
6,966,135 B1 11/2005 McDonald
D554,202 S 10/2007 Knight et al.
D554,203 S 10/2007 Knight et al.
D555,210 S 11/2007 Knight et al.
D555,211 S 11/2007 Knight et al.
D555,212 S 11/2007 Knight et al.
2002/0105143 A1 8/2002 Elliott et al.
2002/0106969 A1 8/2002 Lish
2003/0090060 A1 5/2003 Bedford
2003/0090062 A1 5/2003 Bedford
2003/0094757 A1 5/2003 Bedford
2004/0266316 A1 12/2004 Li et al.
2005/0090178 A1 4/2005 Snyder
2005/0112985 A1 5/2005 Ciccarelli et al.
2005/0153630 A1 7/2005 Delaney et al.
2005/0164594 A1 7/2005 Garr
2006/0021905 A1 2/2006 Johnson
2006/0040582 A1 2/2006 Hopper et al.
2006/0099874 A1 5/2006 Cartlidge et al.
2006/0099875 A1 5/2006 Cartlidge et al.

FOREIGN PATENT DOCUMENTS

EP 647930 B1 4/1995
GB 2159721 A 12/1985
GB 2178331 A 2/1987
GB 2245251 A 1/1992
GB 2295044 A 5/1996
GB 2310421 A 8/1997

| | | |
|---|---|---|
| WO | 93/11843 | 6/1993 |
| WO | 97/09102 | 3/1997 |
| WO | 97/30912 | 8/1997 |

OTHER PUBLICATIONS

Lothar Meggendorfer, Pop-up Book, 1899.
1989 Mattel Catalog, pp. 20, 38, 124, 126.
The Tale of Jemima Puddle-Duck, 1991, photograph of book.
1992 Mattel Girls Catalog, pp. 56, 105, and unnumbered page showing Barbie Play 'N Carry House.
1993 ARCO Catalog, pp. 17-20, Disney Playsets.
1993 Mattel Catalog page Snow White Magical Vanity.
Paul Jackson, Henry Holt, The Pop-Up Book, three pages, 1993.
Pop-Up Box of Colors, 1994, 15 photographs of book.
Galoob Micro Machines playsets, 1995, five photographs.
1998 Arcotoys Catalog, p. 164.
1998 Fisher-Price Catalog, p. 94.
1998 Galoob Catalog pages, "Backpack Club" (copyright 1997).
Michael Welply and Dawn Bentley, The Fairytale Village Pop-Up Playset, The Book Workshop, copyright 1998, three photographs.
Golden Bear 1999 Collection, p. 10.
1999 Mattel Catalog, p. 162.
Adventures in Dwarfland, 2000, photograph of book.
2000 Mattel Catalog, p. 156.
Mattel Matchbox Hero City Take-A-Long playsets, 2003, photograph of toys.
Mattel Matchbox Car Wash Playset Instruction Sheet, 2003.
Mattel Matchbox Rocket Park Playset Instruction Sheet, 2004.
Mattel Matchbox Instruction Sheet G3711, 2004.
2004 Mattel Catalog, page showing Matchbox take-along playsets.
2005 Little Tikes Catalog, pp. 14 and 15.
Matchbox Hero city Instructions Sheet, 2002.
Sabrina fold-out Playhouse, circa 2005, photograph of item.
Hugh Johnson, Ron Van Der Meer, pop-up wine book, 1989, Harper and Row, photograph of book.
Little Tikes toy, photograph.
Pelham Sams Pizza, 1996, Dutton Children's Books Hedgehog Books Limited, photograph of book.
Thomas the Tank Engine Playhouse, photograph.
Shoot The Moon book with playset, 2004, photograph of toy.
Shoot The Moon cottage playset, 2002, photograph of toy.
Karin Roberts, Kelly Popup Playhouse, copyright 2006, three photographs showing package and toy.
Barbie Playground Sisters dolls Pop-up Playground, 2006, two photographs of package.
Playmates Toys Speedez Hummer H2 Speed City, 2004, printout from eToys webpage on Aug. 16, 2006.
Ali Baba and the Forty Thieves Peepshow Book, 1950, Ionicus Houghton Mifflin, photograph of item.
Architecture Pack by Van der Meer, 1996, photograph of book.
1990 Mattel Boys Toys Catalog, pp. 38, and 52-53.
Kall-Kwik-printer advertisement, 1987, photograph of item.
Little Pets Panorama picture book Bavaria London, Nister; New York, E P Dutton, 1896, photograph of book.
Mattel Barbie playhouse, circa 1968, photograph of item.
Mattel Fold Out playset, 1994, two photographs of toy.
Noah's Ark Full of Animals—A Pop-Up Playbook, circa 1994, Tyndale, photographs of book.
Polly Pocket Pop-Up Playsets, Bluebird, 1996, nine photographs.
Wallace Berrie, Smurf Pop-Up Playset, 1983, four photographs.
The Nativity Pop-up, Van der Meer, 1997, photograph of item.
Fall 2005 Mattel Catalog, page showing Barbie® Sweet Dreams Bed & Bath.
Barbie-Kelly Pop-Up Playhouse, circa Jun. 2005, five photographs of toy and packaging.
Hamtaro Popup Playset Kawai, circa Apr. 2003, photograph of item.
Office Action for U.S. Appl. No. 11/446,404.
Jackson, Paul. The Pop-Up Book. 1993, pp. 3,4, 30, 37, 50, 53, 58, 59, 64, 66, 78, 79, 84, 85, 86, 87, 89, 90, 91, 111, 132, 133, 141, 142, 143, 144, 146, 149, 150, 151, 152, 153, & 158. Henry Holt and Company. LLC., New York, NY.
Office Action for U.S. Appl. No. 11/446,404 dated Feb. 18, 2009.
Notice of Allowance for U.S. Appl. No. 11/446,404 dated Aug. 17, 2009.
Robert Sabuda, "Winter's Tale: An Original Pop-Up Journey," 2005, Little Simon, New York.

* cited by examiner

PLAYSETS WITH POP-UP STRUCTURES

This application claims priority to U.S. Provisional Patent Application Ser. No. 60/812,329, which was filed on Jun. 9, 2006 and is entitled "Fold-out Playsets with Pop-Up Structures;" and this application is a continuation-in-part of U.S. patent application Ser. No. 11/446,404, which was filed on Jun. 2, 2006, now U.S. Pat. No. 7,618,301. The complete disclosure of the above-identified patent applications are hereby incorporated by reference in their entirety for all purposes.

BACKGROUND OF THE DISCLOSURE

The present disclosure relates generally to playsets and, more particularly, to playsets with pop-up structures.

Examples of fold-out, pop-up playsets, or more generally playsets with folding construction are found in U.S. Pat. Nos. 243,873, 565,450, 930,108, 953,168, 990,918, 1,008,195, 1,258,788, 1,430,778, 1,551,666, 1,841,041, 1,844,816, 1,870,395, 1,819,932, 1,914,116, 1,992,618, 2,148,279, 2,221,267, 2,458,879, 2,475,471, 2,544,783, 2,648,847, 2,735,109, 2,872,753, 3,108,398, 3,182,420, 3,228,139, 4,030,235, 4,030,234, 4,070,789, 4,337,589, 4,139,967, 4,321,708, 4,130,284, 4,349,973, 4,349,983, 4,365,438, 4,536,162, 4,575,348, 4,657,612, 4,661,080, 4,712,673, 4,774,780, 4,793,006, 4,883,443, 4,898,404, 4,937,207, 4,964,249, 4,946,413, 4,985,935, 5,013,278, 5,019,010, 5,022,681, 5,049,078, 5,096,204, 5,104,124, 5,259,133, 5,293,706, 5,317,823, 5,356,155, 5,480,335, 5,542,870, 5,562,520, 5,613,612, 5,681,199, 5,682,199, 5,682,999, 5,738,221, 5,830,033, 5,839,937, 5,864,973, 5,931,099, 5,943,800, 5,961,149, 6,099,380, 6,146,238, 6,199,308, 6,203,017, 6,311,142, 6,554,685, 6,572,436, 6,725,588, 6,871,853, D258,323, RE26642; in U.S. Patent Application Publication Nos. 2002/0105143, 2002/0106969, 2003/0090060, 2003/0090062, 2003/0094757, 2004/0266316, 2005/0112985, 2005/0153630, 2006/0021905, 2006/0040582, and 2006/0099875; in a U.S. patent application Ser. No. 11/446,404, filed on Jun. 2, 2006 by James A. Knight, Julian Payne, Kwun Chung Mo, Alan Cheung, and Pitt Lau entitled FOLD-OUT PLAYSETS WITH POP-UP STRUCTURES; and in EP 555188A1, EP0647930B1, GB2159721A, GB2178331A, GB2178331A, GB2245251A, GB2295044A, GB2310421A, and WO 97/30912, the complete disclosures of which are hereby incorporated herein by reference in their entirety for all purposes.

SUMMARY OF THE DISCLOSURE

In some examples, a playset may include a support surface and a pop-up structure. The pop-up structure may be coupled to the support surface and may be adapted to be selectively transitioned between a stowed configuration and a deployed configuration. In the stowed configuration, the pop-up structure may be collapsed and may extend along the support surface. In the deployed configuration, the pop-up structure may stand substantially transverse to the support surface. The pop-up structure may include first and second members that may be hingedly coupled to the support surface. The first member may be configured to pivot about a first hinge axis when the pop-up structure is transitioned between the stowed configuration and the deployed configuration. The second member may be configured to pivot about a second hinge axis when the pop-up structure is transitioned between the stowed configuration and the deployed configuration. The pop-up structure may be configured to allow the second member to be selectively rotated relative to the support surface about a rotation axis that may be transverse to the support surface.

In some examples, a playset may include a shell, at least one mount, at least one projectile, a projectile launcher, and a pop-up structure. The shell may include first and second shell members. The first shell member may have a first interior surface, and the second shell member may have a second interior surface. The shell members may be adapted to be transitioned between a closed configuration and an open configuration. In the closed configuration, the first and second interior surfaces may be facing each other. In the open configuration, the shell members may be spaced apart. The at least one mount may be disposed on at least one of the first and second interior surfaces. The projectile launcher may be configured to be retained by the at least one mount. The projectile launcher may be configured to receive, retain and selectively ballistically project the at least one projectile. The pop-up structure may extend transversely from at least one of the first and second interior surfaces when the shell members are positioned in the open configuration. The pop-up structure may include a plurality of elements that may be adapted to be transitioned between a stowed configuration and an erect configuration when the shell members are transitioned between the dosed configuration and the open configuration. In the stowed configuration, the plurality of elements may be disposed between the shell members. In the erect configuration, the plurality of elements may extend generally transversely from the at least one of the first and second interior surfaces.

In some examples, a playset may include a support surface, a pop-up structure, and a movable platform. The pop-up structure may be coupled to the support surface. The pop-up structure may be adapted to be selectively transitioned between a stowed configuration and a deployed configuration. In the stowed configuration, the pop-up structure may be collapsed and may extend along the support surface. In the deployed configuration, the pop-up structure may stand substantially transverse to the support surface. The pop-up structure may include a first member and a second member. The first member may be hingedly coupled to the support surface. The first member may extend along the support surface when the pop-up structure is in the stowed configuration. The first member may extend transversely from the support surface when the pop-up structure is in the deployed configuration. The second member may be hingedly coupled to the first member. The second member may include a first surface. The first surface may extend along the first member when the pop-up structure is in the stowed configuration. The first surface may be spaced from and parallel to the support surface when the pop-up structure is in the deployed configuration. The movable platform may be coupled to the support surface independently of the pop-up structure. The movable platform may be adapted to be selectively transitioned between a first position proximate the support surface and a second position spaced from the support surface. The movable platform may include a second surface. In the first position, at least a first portion of the second surface may be disposed proximate the support surface. In the second position, at least a second portion of the second surface may be disposed proximate the first surface.

DETAILED DESCRIPTION

Figure 1:
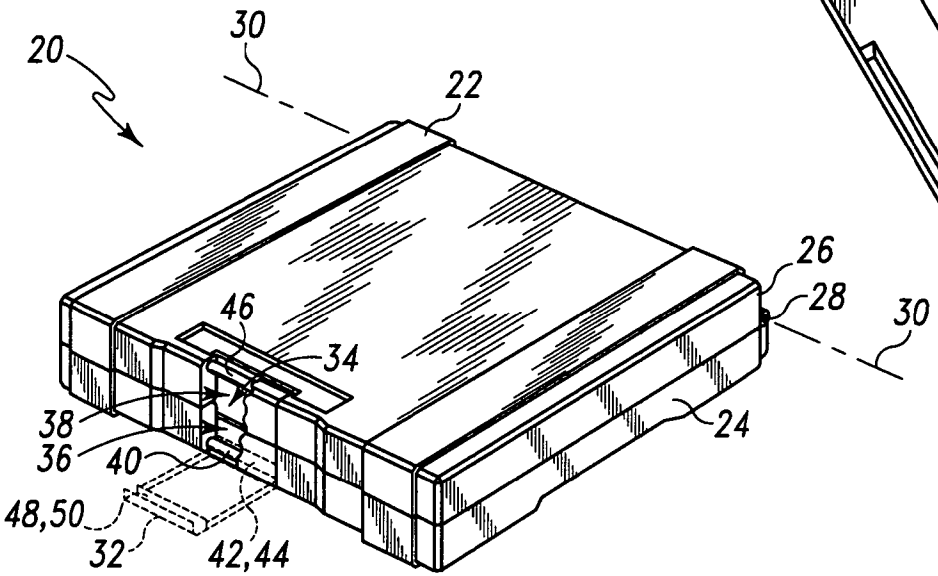
FIG. 1 is a perspective view of an illustrative example of a playset in a closed configuration.
Figure 2:
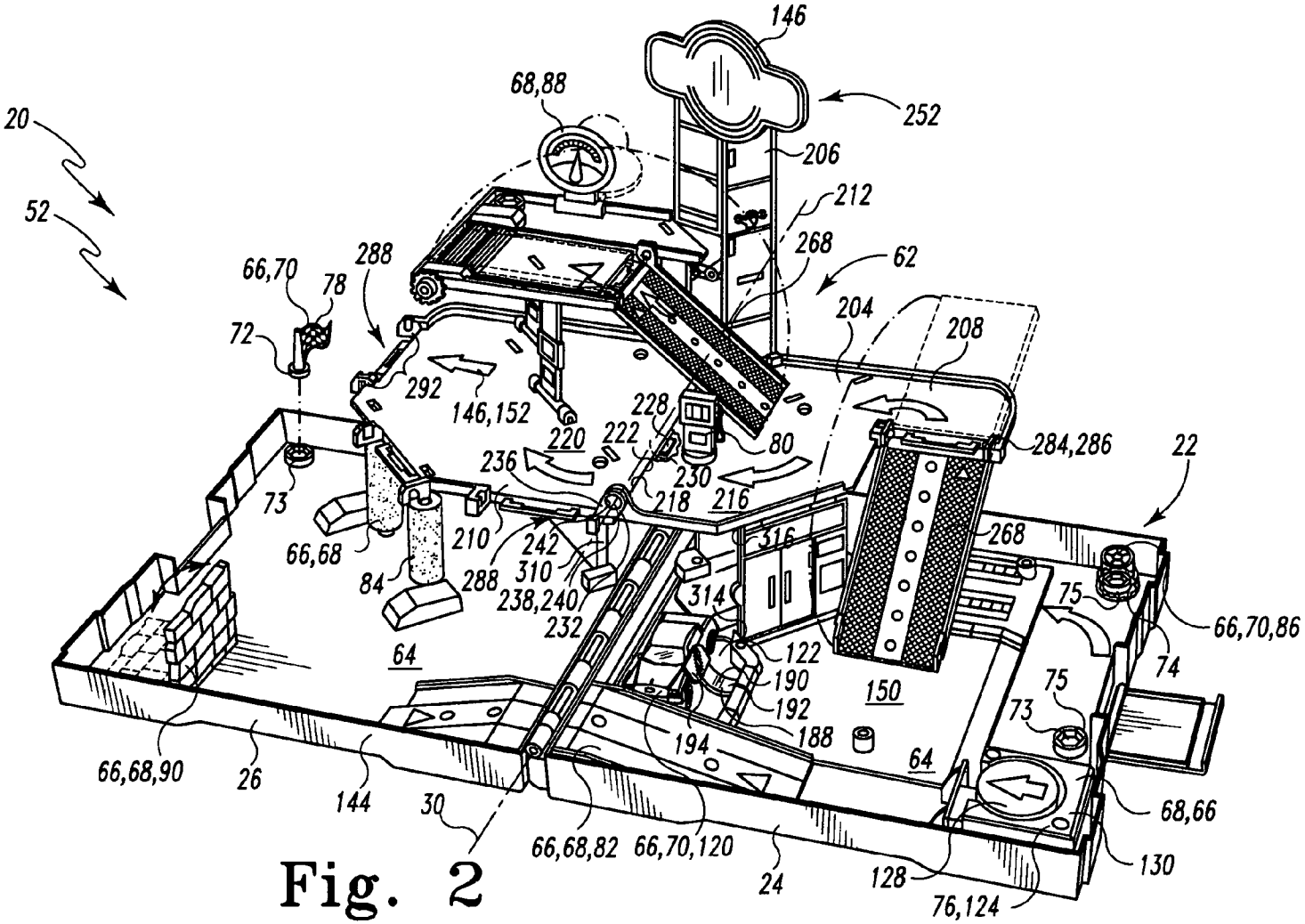
FIGS. 2-6 are perspective views of several illustrative examples of playsets, each in an open configuration.

An nonexclusive illustrative example of a fold-out playset with pop-up structures is shown in FIG. 1 and indicated generally at 20. Unless otherwise specified, each of the playsets 20 disclosed herein may, but are not required to, contain at least one of the structure, components, functionality, and/or variations described, illustrated, and/or incorporated herein. Playset 20 is shown in FIG. 1 in a folded or closed configuration in which the playset may resemble a suitcase or a briefcase. In this configuration, playset 20 may be suitable for compact storage or transport without exposing the inside parts to elements which might damage them. The playset may include a shell 22 formed by a first shell member 24, a second shell member 26, and a shell hinge 28 that couples the first shell member to the second shell member at a shell hinge axis 30. In some illustrative examples, playset 20 may also include a clasp or fastener 32 that may be adapted to secure shell members 24 and 26 together in the closed configuration and/or to link playset 20 to another playset or toy, as is described in greater detail below.

The fastener 32 shown in FIG. 1 is shown in a clasping position in which it is operatively coupled to the first shell member and to the second shell member, which may retain playset 20 in the closed position. In some illustrative examples, first and second shell members 24, 26 may each include a recess portion 34, 36. When playset 20 is in the closed configuration, the recess portions may collectively form a recess 38. Fastener 32 may nest in the recess when coupled to the second shell member.

In some illustrative examples, the fastener 32 may be pivotably coupled to first shell member 24 and/or may be selectively removed from the first shell member manually. FIG. 1 also shows a fastener 32 pivoted away from second shell member 26. The first shell member may include a first cylindrical member, or bar, 40. Fastener 32 may be adapted to engage and/or rotate about the first cylindrical member. Accordingly, the fastener may include a first channel 42 having a first open side 44 that may be adapted to receive the first cylindrical member.

The second shell member 26 may include a second cylindrical member 46 that may be similar in size and/or shape to the first cylindrical member 40, and that may be adapted to couple the fastener to the second shell member. Similarly, fastener 32 may include a second channel 48 having a second open side 50 that may be adapted to receive the second cylindrical member. In some examples, first channel 42 and/or second channel 48 may be formed from a resilient material.

The shell members 24, 26 may be adapted to be transitioned between the closed configuration shown in FIG. 1, in which at least a portion of the shell members, such as the interior surfaces of the shell members, are facing each other, and an open configuration, in which the shell members are spaced apart. Illustrative examples of playset 20 are shown in the open configuration in FIGS. 2-6, 20-28 and 39-43. Each of the playsets may embody a specific play theme, with the adornments and structures of the playset illustrating aspects of that theme. For example, playset 52 may embody an auto center theme with the adornments and structures of the playset illustrating auto repair and/or servicing stations, carwashes, and the like. Similarly, playset 54 may embody a harbor patrol theme with illustrations of a harbor, an airport/heliport, and the like. Playset 56 may embody a snake jungle theme with illustrations of jungle forts. Playset 58 may embody a construction zone theme, with illustrations of scaffolding, cranes, and the like. Playset 60 may embody a dragon castle theme, with illustrations of a dragon, a castle, and the like. Playset 400 may embody a Jurassic or dinosaur theme with illustrations of a volcano and a dinosaur. Playset 600 may embody a fire station theme with illustrations of burning buildings.

Figure 7:
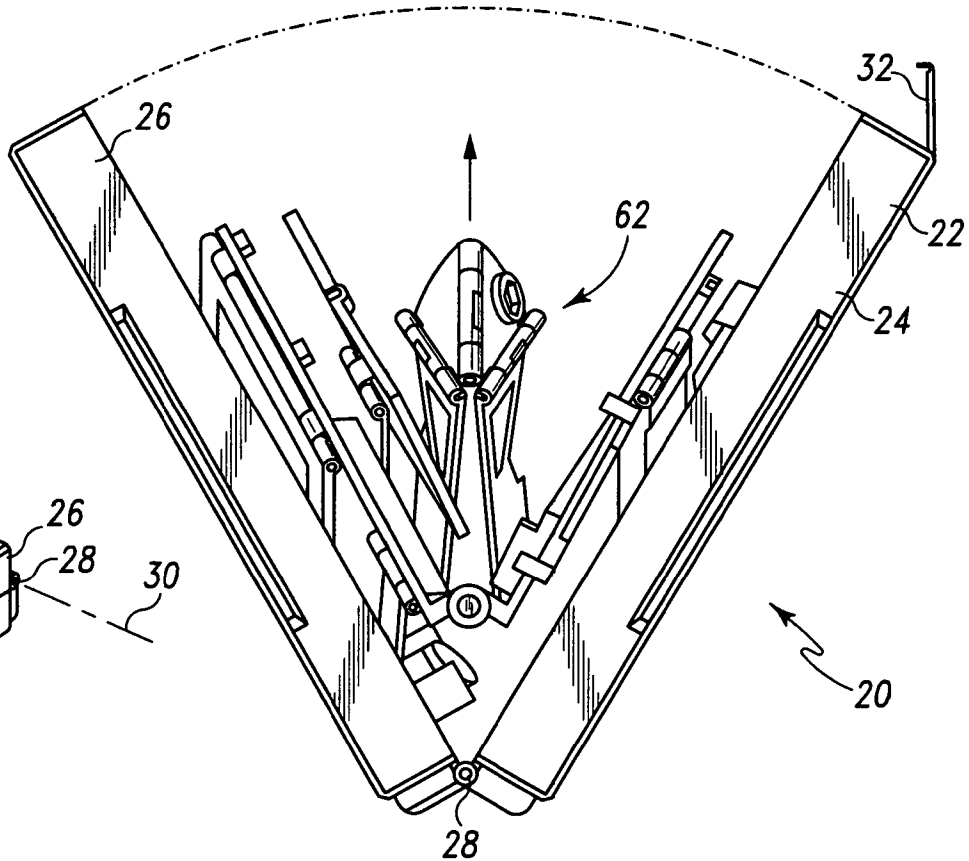
FIG. 7 is a side view of an illustrative example of a playset transitioning between a closed configuration and an open configuration.
Figure 30:
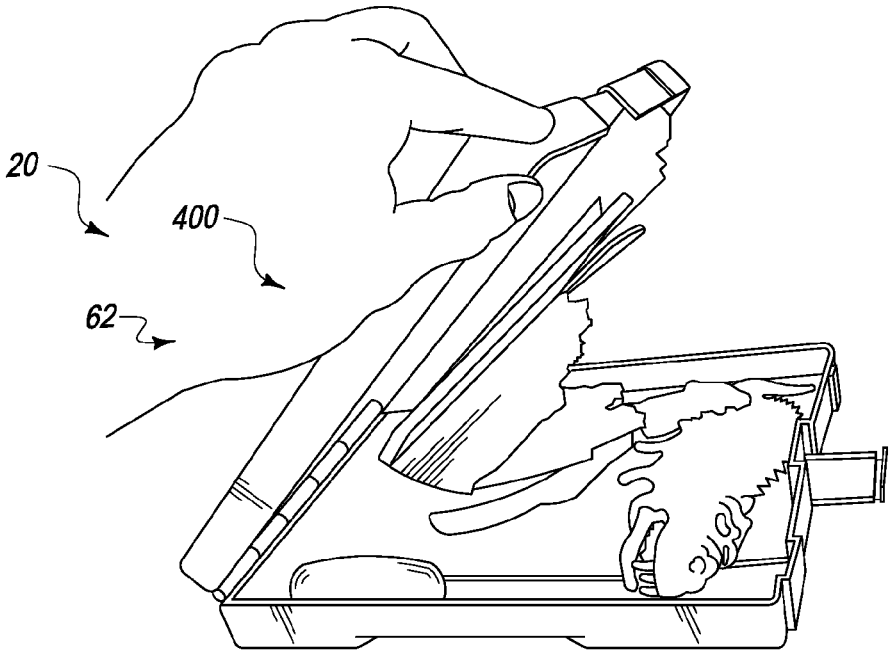
FIG. 30 is a perspective view of the playset of FIGS. 20-28, shown transitioning between a closed configuration and an open configuration.

When playsets 20 are transformed from the closed configuration shown in FIG. 1 to the open configuration shown in FIGS. 2-6, 20-28 and 39-43, a pop-up structure 62, which may be coupled to a support surface 64 of shell 22, may be transitioned from a stowed configuration to an erect or deployed configuration. In some nonexclusive illustrative examples, the support surface 64 may at least partially correspond to one or both of the interior surfaces 65 of the first and second shell members 24, 26. In the stowed configuration, the pop-up structure may be collapsed and may extend along the support surfaces 64 of shell 22, such as is shown or suggested in FIGS. 7 and 9-10. In the erect or deployed configuration, the pop-up structure 62 may stand substantially transverse to the support surface 64 and to one or both of shell members 24, 26, as shown in FIGS. 2-6, 20-28 and 39-43. By "transversely," it is meant that the indicated members are obliquely or perpendicularly oriented. In some nonexclusive illustrative examples, the pop-up structure 62 may be adapted to be selectively transitioned between these aforementioned configurations by a user. In some nonexclusive illustrative examples, the pop-up structure 62 may be configured to transition from the stowed configuration to the deployed configuration, or vice versa, when the playset 20 is transitioned from the open configuration to the closed configuration. FIGS. 7 and 30 show playsets 20 that are between the fully opened and closed configurations.

Playsets 20 may include one or more elements that add play value, such as accessories 66. The accessories may include one or more fixed accessories 68 that may be in a fixed position on the shell and/or the pop-up structure and one or more movable accessories 70. Movable accessories may include at least one extension 72 that may be adapted to be received in one or more accessory mounting apertures 73 and/or at least one collar 74 that may be adapted to receive one or more mounting projections 75. Mounting apertures and mounting projections, which may be provided as a common element, may be disposed in multiple locations on an interior or support surface 64 of shell 22 and/or on pop-up structure 62. As shown, the accessory mounting apertures 73 may have a hexagonal interior that may be recessed or may be formed with a raised ridge, although other shapes and structures are possible. Extensions 72 may have a hexagonal shape that is adapted to mate with the interior of the accessory mounting apertures. In some nonexclusive illustrative examples, the extensions may have a round shape that is adapted to fit inside the accessory mounting apertures such that the movable accessories are adapted to rotate within the accessory mounting apertures. In some nonexclusive illustrative examples, the accessories 66 may have apertures that receive extensions attached to support surface 64 and or to pop-up structure 62. One or more accessories may be included with multiple playsets, one or more accessories may have a different structure and appearance for each playset, and/or accessories may be used with more than one playset. For example, each playset may include any number of specific accessories that illustrate the particular theme of the playset.

Various nonexclusive examples of possible accessories 66 are generally illustrated in FIGS. 2-6, 20-28, 31-43, and 45-50. Nonexclusive examples of accessories 66 may include a launcher 76, a flag 78, a gas pump 80, a jumping ramp 82, a carwash 84, a tire wrench 86, a tachometer 88, a collapsible wall 90, a wind sock 92, a radar dish 94, binoculars 96, an amulet 98, a launching platform 100, a spring-loaded trap 102, a zip line 104, a barrier 106, a crane 108, a roof truss 110, a treasure chest 112, a door 114, a trap door 116, a dragon 118, a vehicle 120, and an accessory retention chamber 122.

Figure 20:
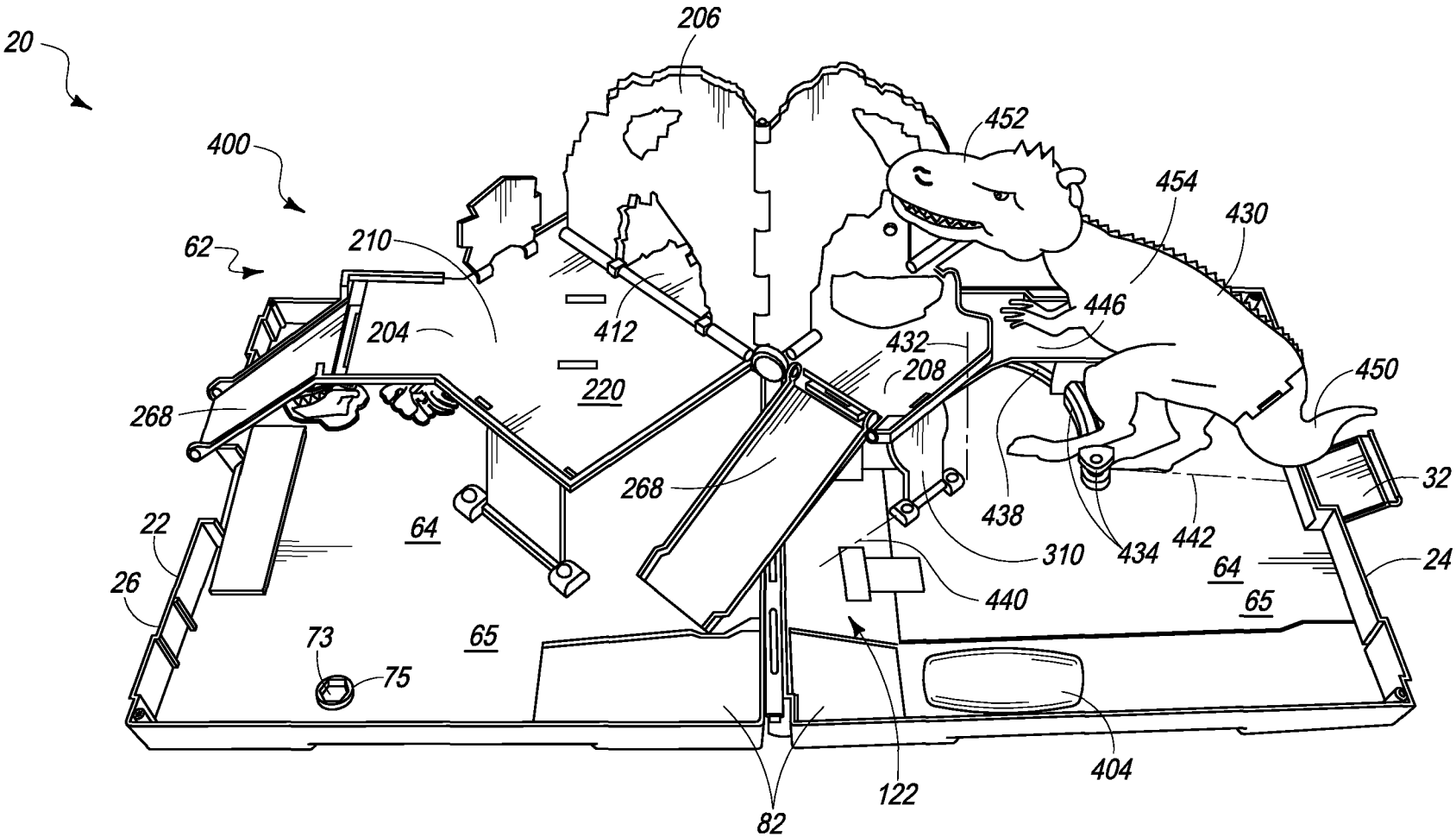
FIGS. 20-28 are perspective views of another illustrative example of a playset, shown in an open configuration.
Figure 31:
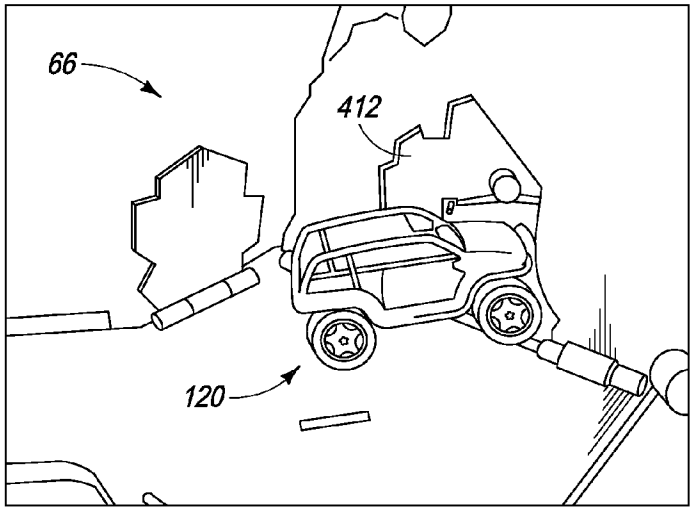
FIGS. 31-34 are perspective views of illustrative examples of accessories suitable for use with a playset, such as the playset of FIGS. 20-28.
Figure 32:
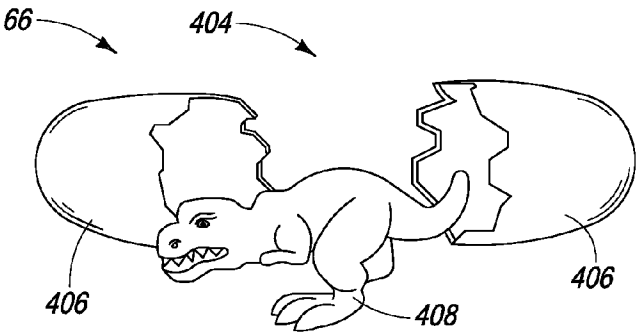
Figure 33:
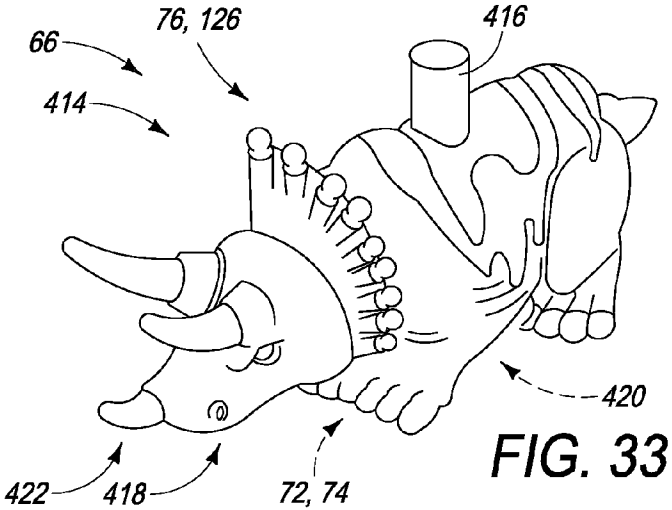
Figure 34:
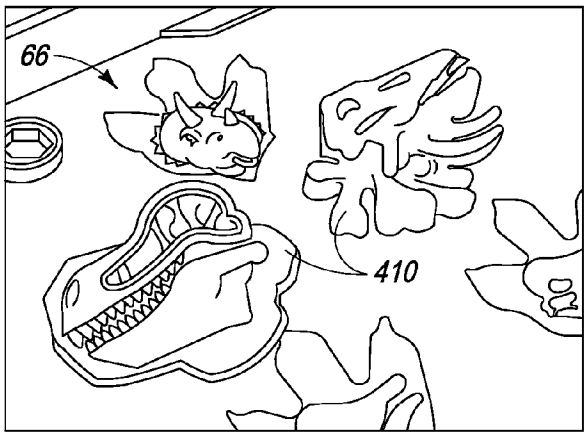
Figure 38:
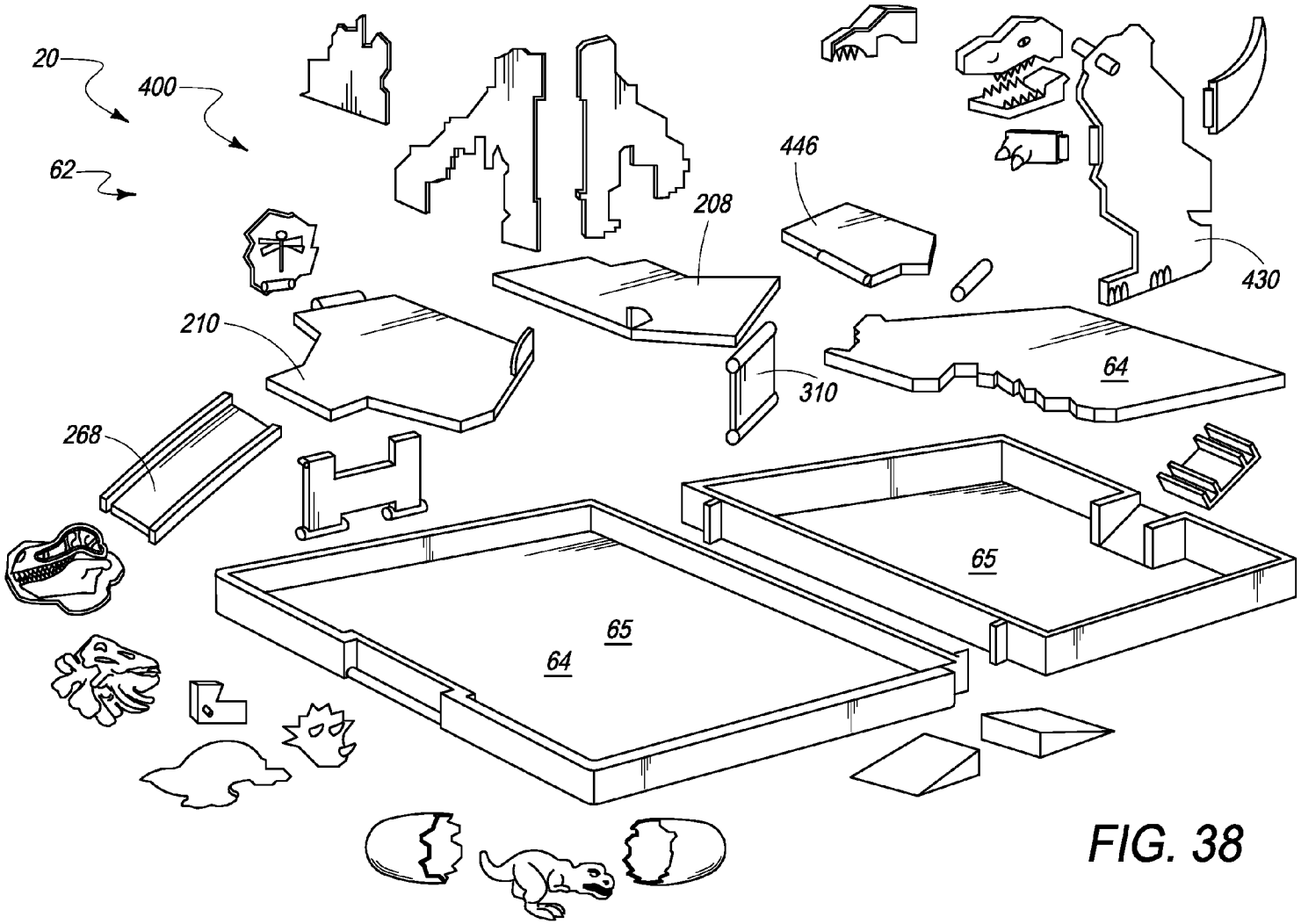
FIG. 38 is an exploded view of an illustrative example of a playset such as the playset of FIGS. 20-28.

Another nonexclusive example of an accessory that may be provided with playset 30 may be an egg 404, as shown in FIGS. 20, 32 and 38. Egg 404 may include a plurality of egg portions 406 that may be adapted to transition selectively between a closed configuration in which the egg portions are mated together, as shown in FIG. 20, and an open configuration in which the egg portions are separated from one another, as shown in FIG. 32. In the closed configuration, the egg portions may be adapted to house a baby dinosaur 408 inside egg 404. Additional nonexclusive examples of accessories 66 may include fossils 410, as shown in FIG. 34, or a door 412, as shown in FIGS. 20 and 31.

In some nonexclusive illustrative examples, playset 20 may include a launcher 76 that is configured to propel one or more vehicles 120, such as across support surface 64 or up a jumping ramp 82. The launcher may be adapted to propel one or more vehicles 120 when a spring loaded portion 134 is pulled back at a first end 136 and released when a vehicle is placed against a second end 138. As shown in FIGS. 2-3, 5-6 and 27, playsets 52, 54, 58, 60 and 400 may each include a launcher 76, which may be considered either a fixed launcher 124 or a movable launcher 126.

A fixed launcher 124 may be a fixed accessory 68 of playsets 20, or specifically of playsets 52 and 54. The fixed launcher may be formed by a lever arm 128 that is pivotably coupled to a base 130 such that pressing upon a first end of the lever arm causes the lever arm to pivot such that a second end of the lever arm propels one or more vehicles 120 across support surface 64.

A movable launcher 126 may be a movable accessory of playsets 20, or specifically of playsets 58, 60 and 400. For example, cement mixer launcher 132 of playset 58 is adapted to be inserted into one or more accessory mounting apertures 73. Crossbow launcher 140 may include a lever arm 128 that is coupled to a movable base 142. Another example of a movable launcher 126 is the dinosaur launcher 414 shown in FIGS. 27 and 33. The dinosaur launcher 414 may include an actuator 416 that may be coupled to a head portion 418 via an appropriate linkage 420. Linkage 420 may include gears, cams, biasing elements, and other devices that may be adapted to translate linear motion of actuator 416 to rotational motion of head portion 418. As the head portion rotates upwards, nose 422 may be thrust substantially forward, thereby propelling a vehicle 120, such as along support surface 64 and/or up one or more jumping ramps 82.

Some examples of playset 20 may include one or more jumping ramps 82 that are disposed in various configurations. For example, the jumping ramps may be disposed in alignment with a fixed launcher 124, may be configured in a paired arrangement that straddles shell hinge 28, and/or may lead to the edge of shell perimeter 144. In some nonexclusive illustrative examples, jumping ramps 82 may be straight or may be curved.

Playsets 20 may include one or more scenery elements 146, which may also be considered an accessory 66. For example, playset 54 shown in FIG. 3 includes a lighthouse 148. The lighthouse may be adapted to be pivoted between a deployed position, in which the lighthouse stands transverse to support surface 64, and a stowed position, in which the lighthouse extends along the support surface. Other illustrative examples may include various scenery elements 146 that are formed or coupled to a surface liner 150 that is operatively coupled to one or both shell members and/or the support surface, and/or formed or coupled to the pop-up structure. Scenery elements 146 may be affixed to the support surface and/or to the pop-up structure as applied decals, as painted images and/or as fastened elements. Additional examples of scenery elements may include graphic elements 152, helipad 154, and the like.

Figure 4:
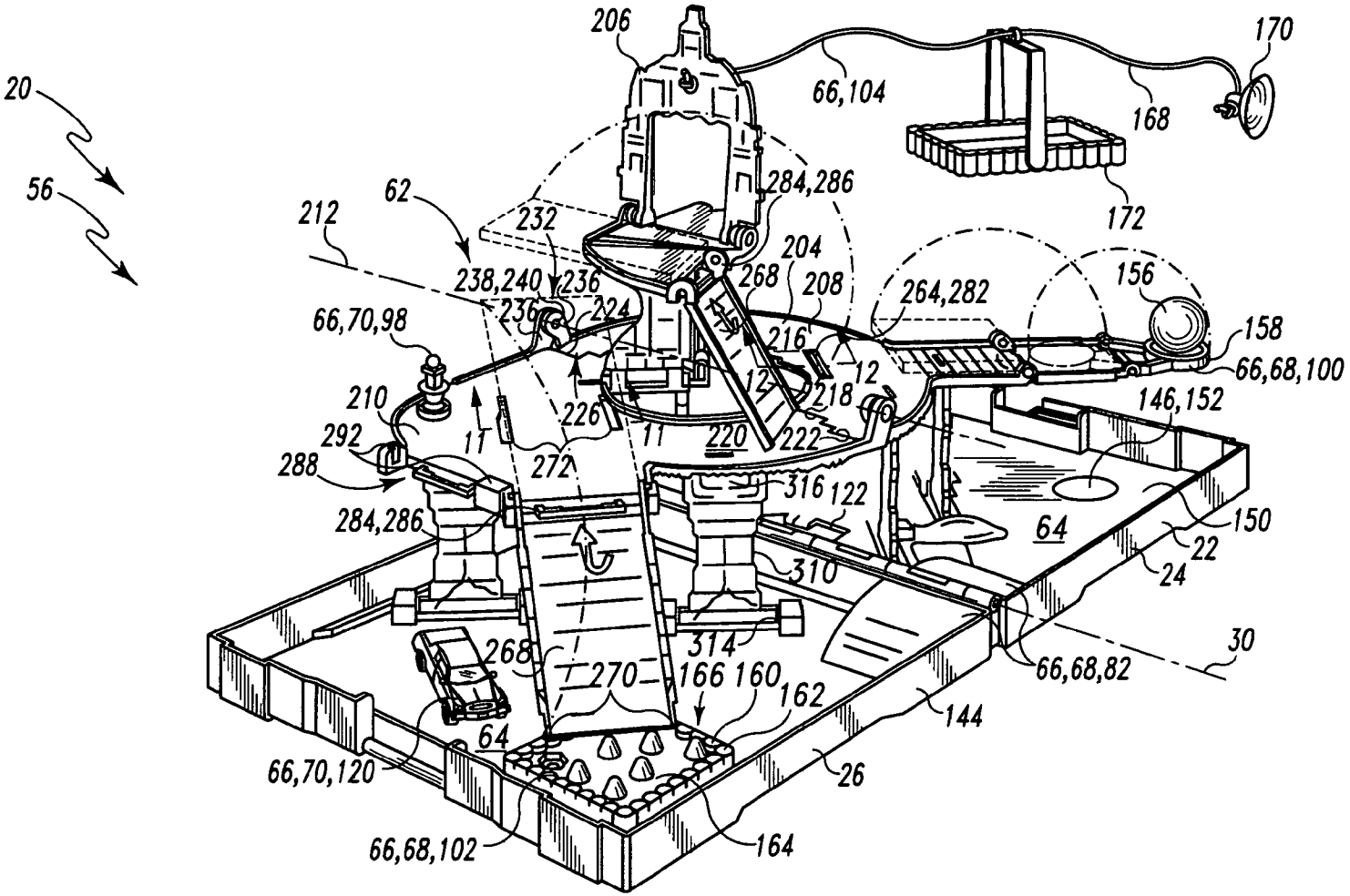

Playset 56, as shown in FIG. 4, includes a launching platform 100 that is formed integrally with the pop-up structure 62 of the playset. Launching platform 100 may be adapted to be folded out from the pop-up structure by a user. Moreover, the launching platform may be biased towards a raised position, such that, when an object such as a boulder 156 is placed within an end portion 158 and the launching platform is lowered, the object may be propelled airborne.

Playset 56, as shown in FIG. 4, also includes spring-loaded trap 102 and zip line 104. The spring loaded trap may include one or more pins 160 that are positioned within a base 162 such that the pins are adapted to move between a lowered position in which the tops of the pins are approximately level with a top surface 164 of the base and a raised position in which the pins extend above the top surface, as shown. In some illustrative examples, the pins may be biased toward the raised position, and may be adapted to be retained in the lowered position by a retention mechanism (not shown) until actuator button 166 is pressed either directly by a user, or by an accessory such as one or more vehicles 120 contacting the actuator.

Zip line 104 may include a line representing a cable 168 that may be suspended between the pop-up structure 62 and a wall, cabinet, or other suitable erect surface external to the playset. The zip line may include a suction cup 170, which may be adapted to attach the cable to the substantially erect surface, and a movable platform 172, which may be suspended from cable 168. The movable platform may be adapted to transport one or more accessories 66, such as vehicle 120, to or from the pop-up structure during play activities with playset 56.

Figure 5:
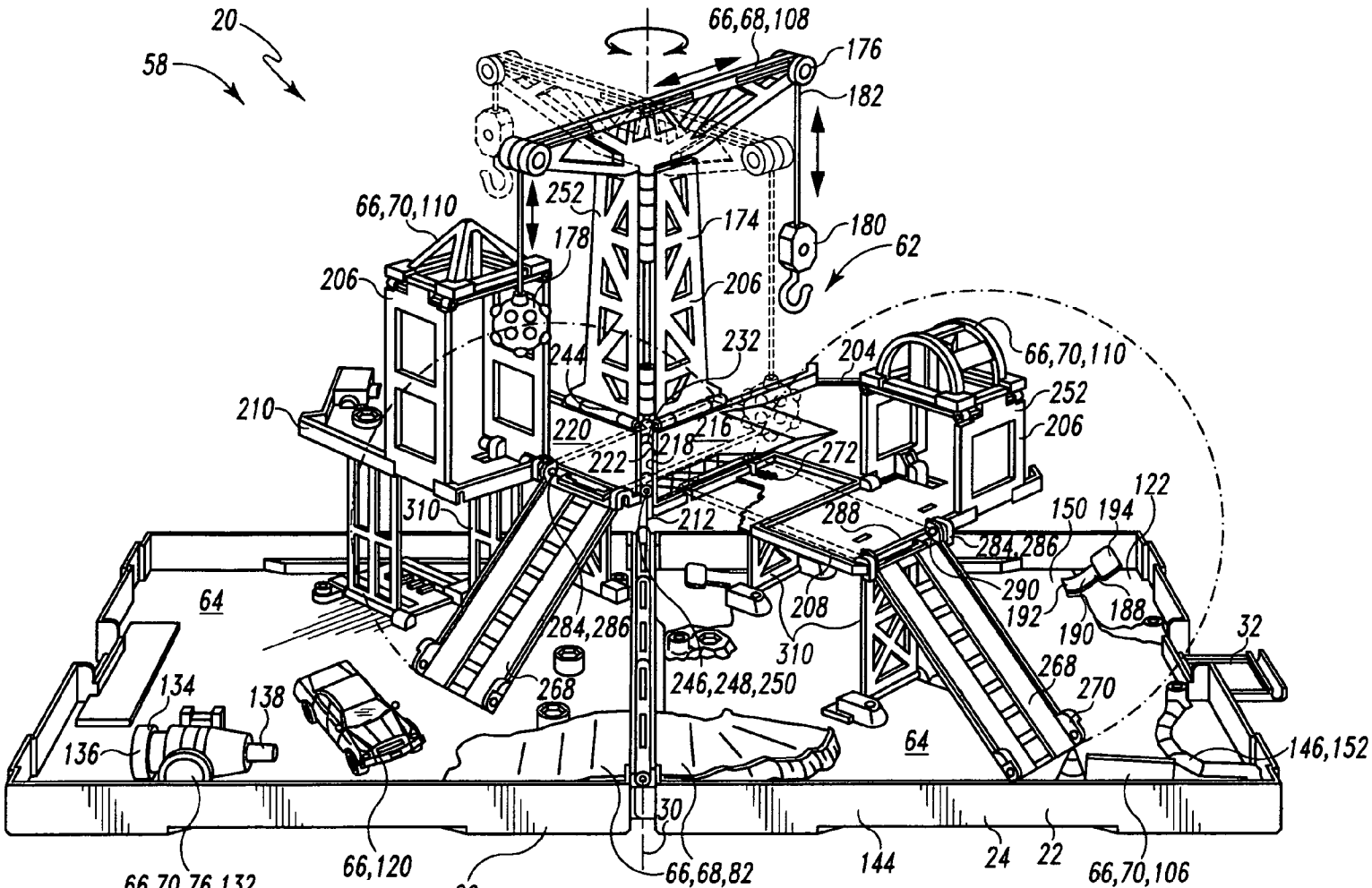

Playset 58, as shown in FIG. 5, includes crane 108. The crane may include a tower 174 and a boom 176 rotatably attached to the tower. Boom 176 may be coupled to a wrecking ball 178 and a hook 180 with a cable 182. The relative lengths of the cable 182 associated with wrecking ball 178 and/or hook 180 may be adjustable. As shown in FIG. 5, cable 182 may be pulled back and forth through boom 176 to adjust the relative lengths of the cable. Accordingly, a user may transport one or more accessories 66, such as roof trusses 110, using hook 180, or knock over accessories or elements of the pop-up structure using wrecking ball 178 by manipulating crane 108 during play with playset 56.

Figure 6:
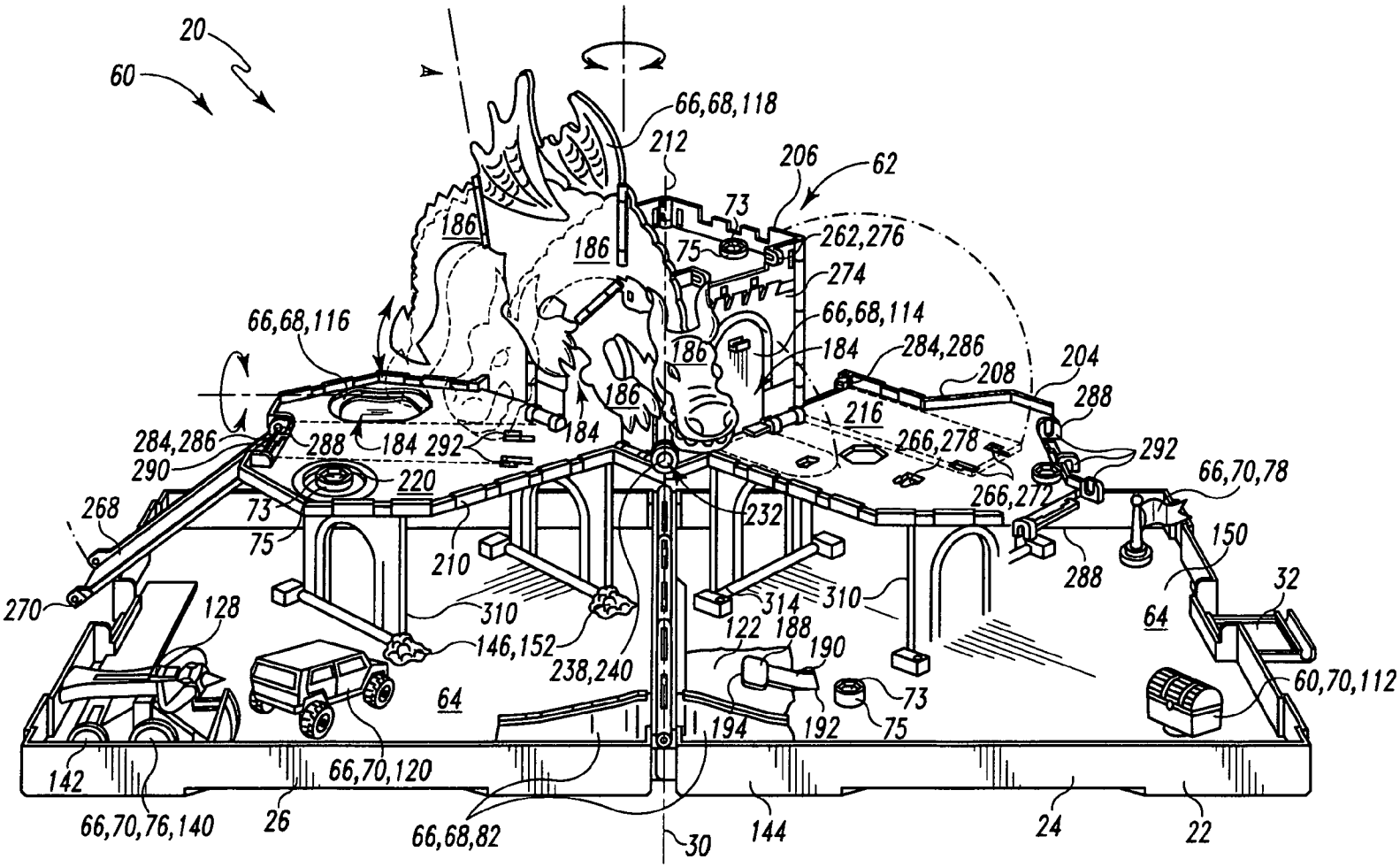

Playset 60, as shown in FIG. 6, includes door 114, trap door 116 and dragon 118. These accessories may be pivotably coupled to pop-up structure 62 to allow other accessories, such as vehicles 120, to pass through one or more openings 184. Moreover, these accessories may include a latch mechanism to retain the accessory in a position in which it is blocking the corresponding opening. Additionally, dragon 118, or any other accessory 66, may include other manipulatives 186 to enhance the play value of playsets 20, such as hinges and movable parts at the mouth, the neck, the legs, and the tail of the dragon.

Figure 8:
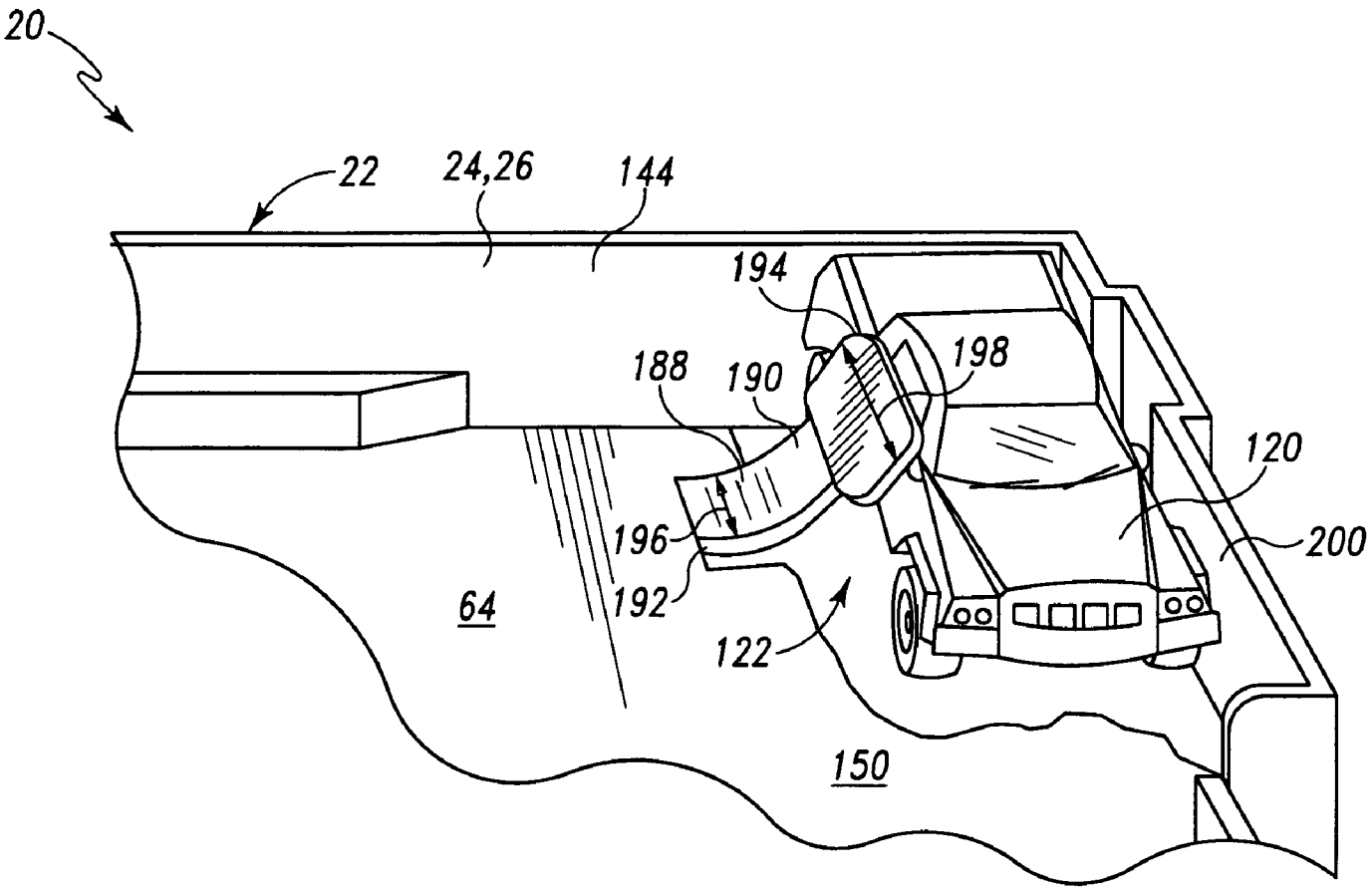
FIG. 8 is a perspective partial view of an illustrative example of a playset-accessory retention chamber retaining an illustrative example of a playset accessory.

As shown in the illustrative example presented in FIG. 8, playsets 20 may include at least one playset-accessory retention chamber 122. The playset-accessory retention chamber 122 may include an arm 188 that has a resilient portion 190 disposed between a first end 192 and a second end 194. The first end 192 may be attached to support surface 64 of shell 22. The resilient portion 190 may be adapted to urge the second end 194 from a displaced position spaced apart from the support toward a rest position adjacent to the support surface 64. Shown more particularly in FIG. 8, the arm may be configured such that a width 196 of the resilient portion is narrower than a width 198 of second end 194. In some nonexclusive illustrative examples, arm 188 may be operatively coupled or formed integrally with surface liner 150.

The playset-accessory retention chamber 122 may also include a barrier 200 that may be mounted on the support surface spaced apart from and facing the arm. Barrier 200 may include a portion of perimeter 144 of shell 22. Accordingly, at least a portion of the barrier may be substantially perpendicular to the support surface.

FIG. 8 shows an illustrative playset-accessory retention chamber 122 with a playset accessory, specifically, a vehicle 120, retained inside. Arm 188 is shown in the displaced position in which resilient portion 190 is urging second end 194 toward the rest position. Because vehicle 120 has been positioned within the playset accessory retention chamber, second end 194 is adapted to abut a side of the vehicle and to bias the vehicle against barrier 200. In this manner, playset-accessory retention chamber 122 may be adapted to retain an accessory, such as a vehicle 120, when playset 20 is transitioned to the folded configuration, inverted, transported, etc.

Figure 9:
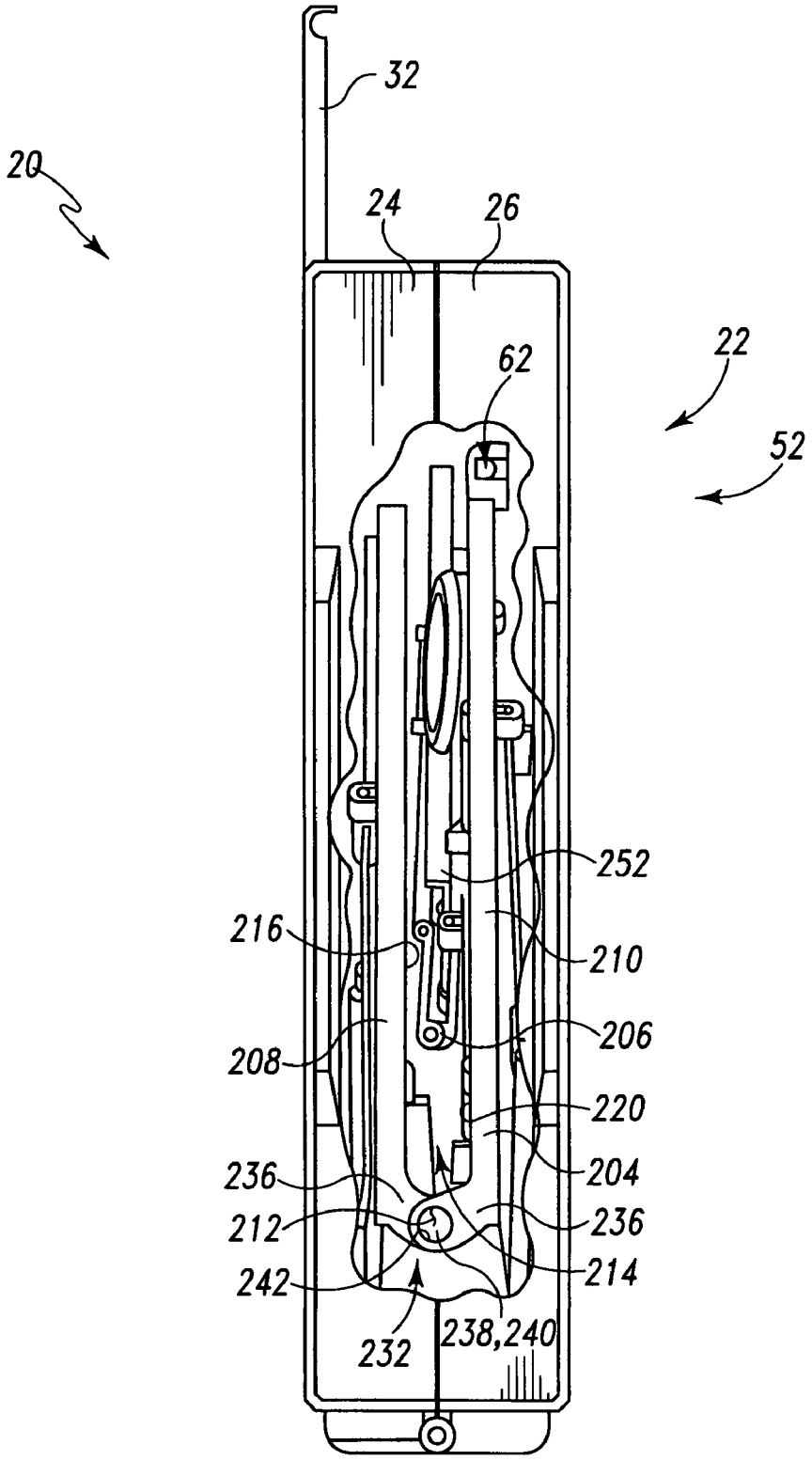
FIGS. 9-10 are cutaway side views of playsets in closed positions.
Figure 10:
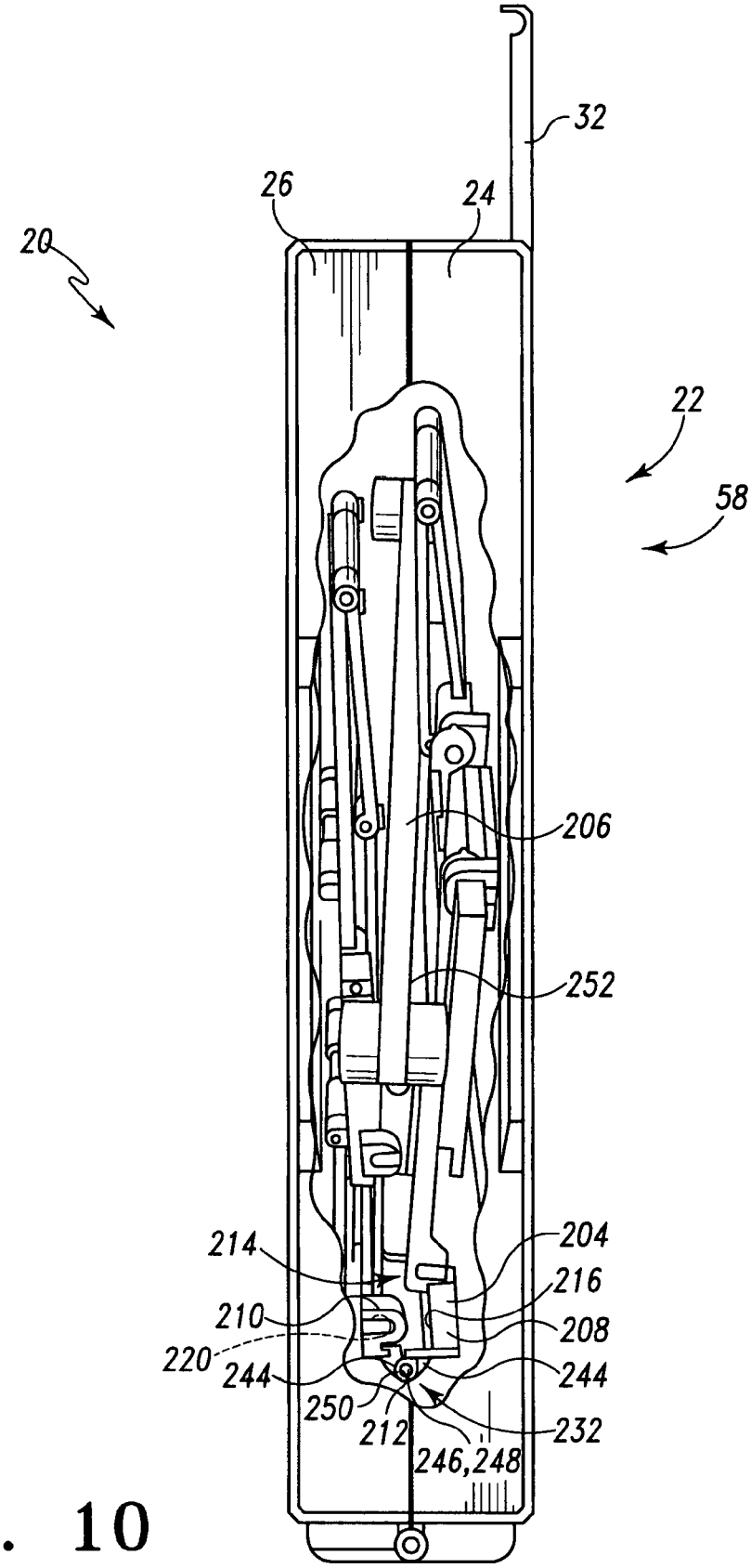

As shown in the nonexclusive illustrative examples presented generally in FIGS. 2-7, 20 and 39, the pop-up structure 62 may include a platform 204 and one or more erect assemblies 206. In some illustrative examples, platform 204 may be substantially parallel to or otherwise extend along support surface 64 when the pop-up structure 62 is in the deployed configuration. The platform may be formed from a first platform member 208 and a second platform member 210 that is hingedly coupled to the first platform member 208 at a platform hinge axis 212. When the pop-up structure 62 is in the stowed configuration, as illustrated in FIGS. 9-10, the platform may be configured such that the first platform member 208 faces and is substantially parallel to the second platform member 210 and is positioned at a distance from the second platform member to form a gap 214.

Similarly, first platform member 208 may include a first surface 216 and a first edge 218 and second platform member 210 may include a second surface 220 and a second edge 222. Platform 204 may be configured such that, when pop-up structure 62 is in the deployed configuration, the first edge may abut the second edge, and the first surface may be continuous with the second surface. In some illustrative examples, such as those shown in FIGS. 3-4, platform 204 may include at least one tab 224 that may be adapted to fit matingly within at least one corresponding indentation or aperture 226 to align the first and the second platform members. In other illustrative examples, such as the illustrative example shown in FIG. 2, platform 204 may include at least one tab 228 that matingly abuts a bottom surface 230 to align the first and the second platform members. It is within the scope of this disclosure that tabs 224 and 228, as well as apertures 226, be included with either or both platform members 208 and 210; that platforms 204 include a mixture of these or different alignment mechanisms; or that no alignment mechanism be used.

Pop-up structure 62 may include a platform hinge element 232 that couples first platform member 208 to second platform member 210. Platform hinge element 232 may be adapted to pivot the second platform member relative to the first platform member about a platform hinge axis 212. The platform hinge axis may be spaced away from one or both platform members. In some illustrative examples, at least one platform hinge element 232 may be disposed at an edge 646 of the platform 204 or in an interior region 648 of the platform 204, such as shown in the illustrative example presented in FIG. 39. In some illustrative examples, platform hinge element 232 may include one or more arm portions 236 that are operatively coupled to, or formed integrally with, one or both platform members. In these illustrative examples, the platform hinge element may also include a connecting member 238 that is adapted to pivotably couple the platform members. Connecting member 238, as shown in FIG. 9 may be a rigid pin 240 that is inserted within an aperture 242 on each arm portion 236.

In some illustrative examples, platform hinge element 232 may include a ridge portion 244 that may be operatively coupled to, or formed integrally with, each of the platform members. In these illustrative examples, a connecting member 246 may be adapted to pivotably couple ridge portions 244. Connecting member 246, as shown in FIG. 10, may be a rigid bar 248 that is inserted within a channel 250 formed in interdigitated portions of ridge portions 244.

Erect assembly 206 may include a plurality of elements 252 that are adapted to be transitioned between an erect configuration in which the erect assembly extends transversely from platform 204 and/or support surface 64 and a stowed configuration in which the elements are collapsed and/or disposed between the shell members. As shown in the illustrative example presented in FIG. 9, the elements of the erect assembly may be adapted to extend within gap 214 when the pop-up structure is in the stowed configuration.

Figure 11:
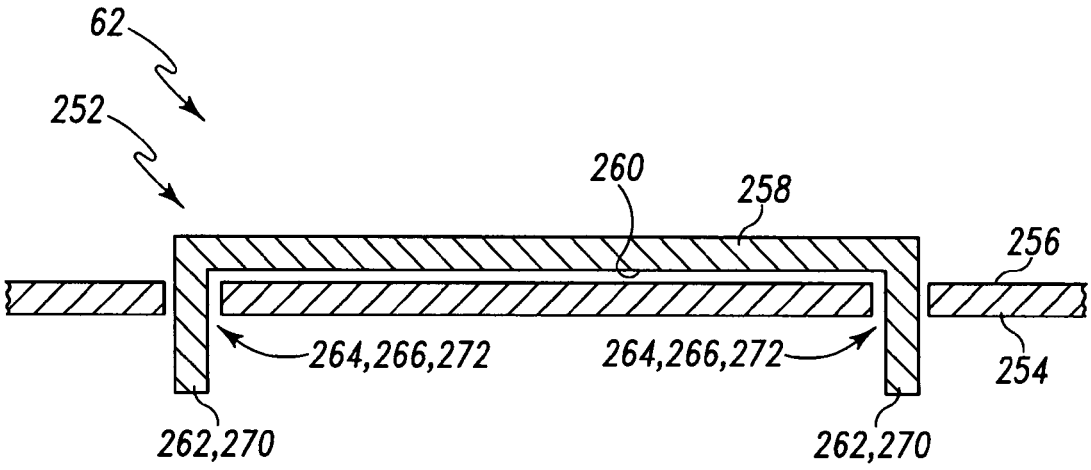
FIGS. 11-12 are partial cross-section views of illustrative examples of first and second members of pop-up structures.
Figure 12:
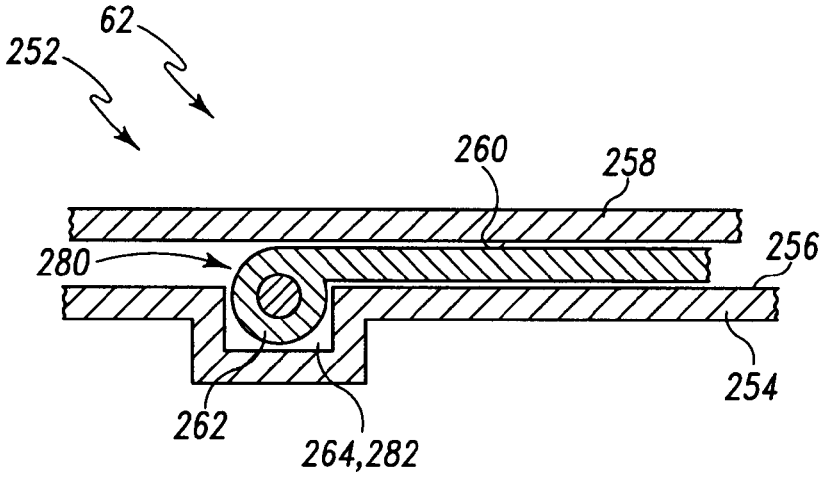

Pop-up structure 62 may include one or more elements and/or features that enable elements 252 to be collapsed compactly to reduce the overall thickness of erect assembly 206 and/or the entirety of pop-up structure 62 when it is in the stowed configuration. For example, as shown in FIGS. 11-12, the pop-up structure may include a first member 254 having a first surface 256 and a second member 258 having a second surface 260. When pop-up structure 62 is placed in the stowed configuration, the second member may be adapted to be placed adjacent to the first member with the second surface against the first surface. Second surface 260 may include a protrusion 262 that may be inserted into a receiving portion 264 formed on first surface 256, or within first member 254.

In some illustrative examples, receiving portion 264 may include an aperture 266 formed within first member 254. One example of aperture 266 and protrusion 262 may be included with the playsets 20 shown in FIGS. 3-6, and is shown more particularly in FIG. 11. These examples include second members 258, embodied by ramps 268, that each include at least one protrusion 262, embodied by ramp protrusions 270. These figures also show first members 254, embodied by first and/or second platform members 208, 210, that each include at least one corresponding aperture 266, embodied by ramp apertures 272. When the pop-up structure is in the stowed configuration, each ramp may be placed against the corresponding platform member, with the ramp protrusions inserted into the ramp apertures.

In some examples, second members 258, or more particularly, ramps 268, may be adapted to be moved selectively by a user between a folded position and an unfolded position. In the folded position, the second member may be placed against the first member with the second surface against the first surface and the protrusion (ramp protrusion 270) inserted into the receiving portion (ramp aperture 272). In the unfolded position, the second surface may be separated from the first surface. In some examples, the second member may be adapted to move from the folded position automatically to the unfolded position during the deployment of pop-up structure 62.

For example, second members 258, or more particularly one or more erect assembly elements 252, such as the castle wall 274 shown in FIG. 6, may be adapted to be placed adjacent to platform members 208, 210 when pop-up structure 62 of playset 60 is moved to the stowed configuration. The castle wall, as can be seen in FIG. 6, includes a wall protrusion 276 that may be adapted to be inserted into a platform aperture 278, which may be formed on one of the platform members 208, 210, when the pop-up structure is transitioned to its folded configuration.

Figure 3:
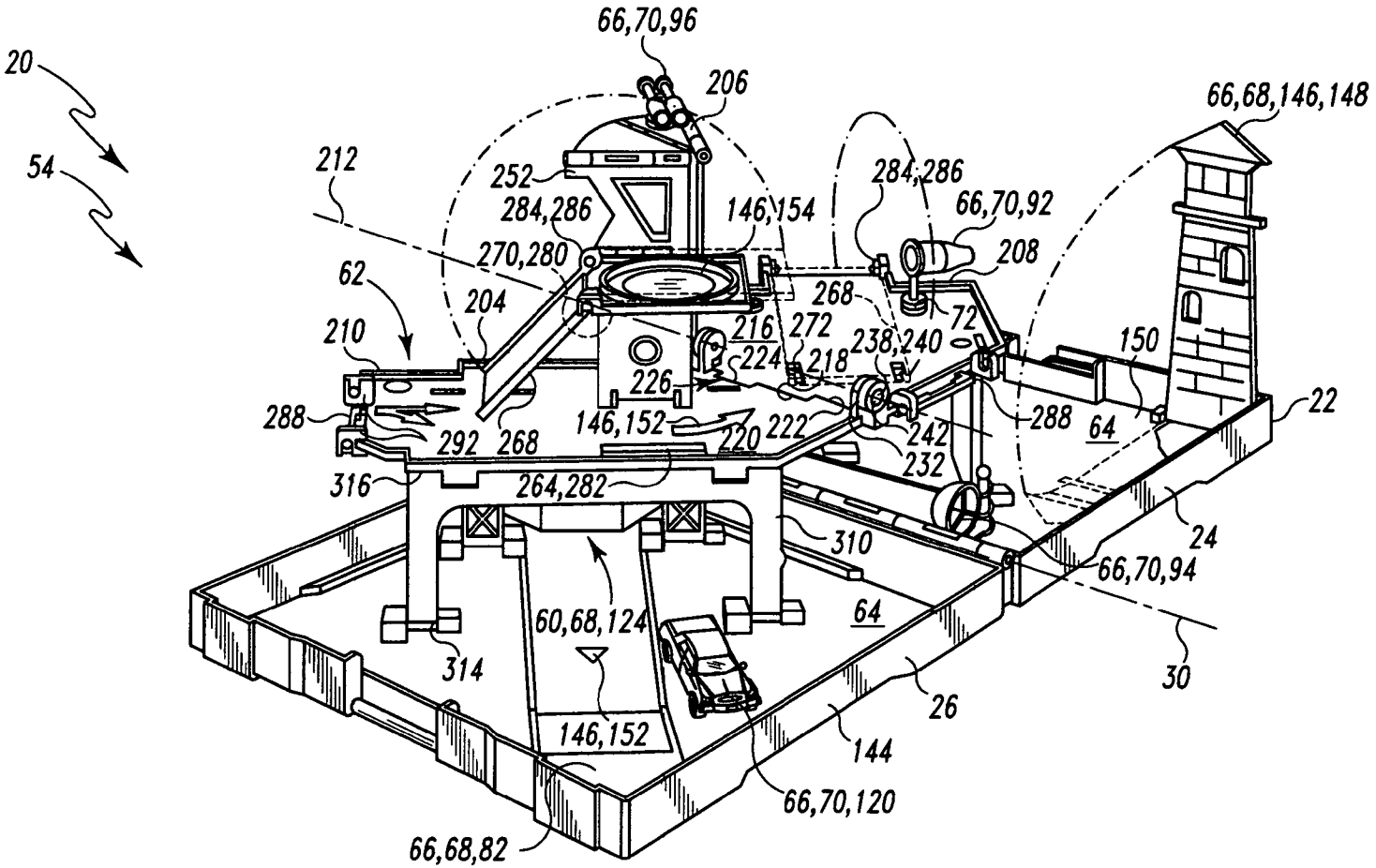

Another example of one or more erect assembly elements 252 embodying second member 258 is shown in the playsets 20 presented in FIGS. 3-4, and more particularly in FIG. 12. Specifically, the erect assembly elements may form a hinge 280, a portion of which may be adapted to be inserted into receiving portion 264, specifically a recessed portion 282 of first surface 256 and/or first member 254, embodied by platform members 208, 210. Recessed portions 282 may have any shape, such as the rectangular indentation shown in FIG. 3, or the rounded indentation shown in FIG. 4. It is within the scope of this disclosure that protrusions and receiving portions may be disposed in multiple locations, and may assume multiple forms, such as notches, cutouts, gaps, and so forth, and that protrusions and receiving portions may assume various regular and/or irregular shapes. Moreover, pop-up structure 62 may include a plurality of first members and second members, having a plurality of first and second surfaces, and a plurality of protrusions and corresponding receiving portions. Additionally, each first and second member may have any suitable number of protrusions and corresponding receiving portions.

Figure 13:
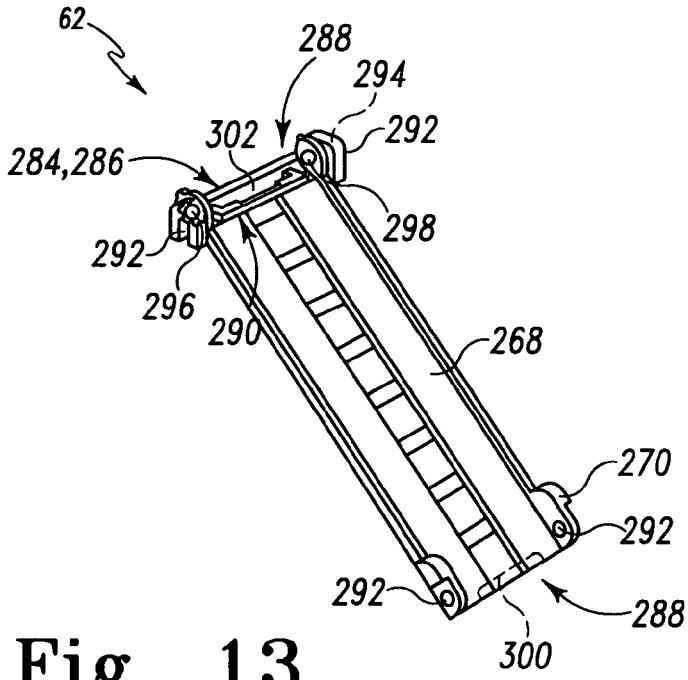
FIG. 13 is a perspective partial view of an illustrative example of a pop-up structure.

Ramps 268, as shown in FIGS. 2-6 and more particularly in FIG. 13, may be hingedly coupled to pop-up structure 62, or more specifically, to platform 204. Accordingly, the pop-up structure may include at least one hinge joint 284. In some illustrative examples, ramps 268 may be removably coupled to pop-up structure 62 as well. Pop-up structures of these illustrative examples, accordingly, may include one or more removable hinge joints 286, which may include a ramp acceptor 288 and a connector 290. In the illustrative examples presented in the drawings, ramp acceptor 288 is embodied by one or more notches 292 on platform 204 and/or other locations on pop-up structure 62. Connector 290 is embodied by one or more pins 294 disposed on ramps 268.

Pin 294 may include an outer portion 296 that may be adapted to mate with notch 292 and an inner portion 298 that may be adapted to mate with an alternate ramp acceptor 288, which may be present on another ramp 268 as part of ramp protrusions 270, or on any other suitable location on pop-up structure 62. To enhance the play value of playsets 20, platform 204, or pop-up structure 62, may include any number of ramp acceptors, and a playset 20 may include a greater number of ramp acceptors than ramps, leaving the location of connection of each ramp up to the user. Ramp acceptors 288 may be disposed in any position and at any orientation relative to platform hinge axis 212. It is within the scope of this disclosure that ramp acceptors 288 and connectors 290 may include any suitable mechanisms to mate the ramps to the pop-up structure, including reversing the positioning of the notches and the pins, and the like.

Ramps 268 may be adapted to connect to pop-up structures in other ways. As shown in FIGS. 4-5, one or more ramps may include a tab 300 that is adapted to fit within a slot 302. In the illustrative examples shown, several slots 302 are disposed between notches 292 on ramp acceptors 288. Additionally, the playset 56 of FIG. 4 may include a slot 302 in platform 204 that may be adapted to selectively secure one or more ramps 268 in a deployed position while pop-up structure 62 is in the deployed configuration. Playset 56 may also include a slot 302 in base 162 to selectively secure one or more ramps 268 in position while pop-up structure 62 is in the deployed configuration.

In other illustrative examples, slots 302 may be disposed in any suitable location, such as on other locations on platform 204, or on another ramp. In this way, a user may connect a first fold-out playset 20 having pop-up structures 62 to another playset, which may be a second playset 20, or any other playset having compatible mating connections.

Figure 14:
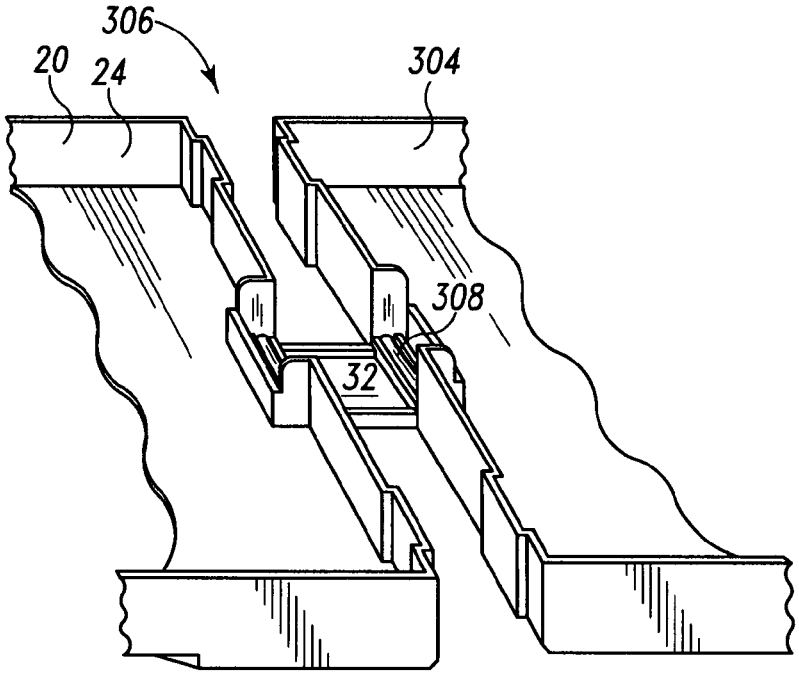
FIG. 14 is a perspective partial view of an illustrative example of a playset system showing a fastener in a linking position between first and second playsets.

FIG. 14 shows an additional manner in which a first playset 20 may connect with a second playset 304, thereby forming a playset system 306. As has been mentioned previously, playsets 20 may include a clasp or fastener 32 that may be adapted to retain the playset in the closed configuration, and/or may be adapted to link the playset to another playset or toy.

Fastener 32 may be adapted to be selectively moved between the clasping position shown in FIG. 1 and the linking position shown in FIG. 14, in which the fastener is coupled to second playset 304. Playset 304 may include a bar 308 that may be adapted to couple the fastener to the second playset. In some examples, first shell member 24 may be spaced apart from second playset 304 when fastener 32 is operatively coupled to the second playset.

With continued reference to FIGS. 2-6, pop-up structures 62 may include a plurality of standards 310 that are hingedly coupled to one or both shell members 24, 26, or to support surface 64 at a bottom end 314. The standards may also be hingedly coupled to platform members 208, 210 at a top end 316. As has been previously discussed, when shell members 24, 26 and the pop-up structure 62 are in the closed or stowed configuration, pop-up structure 62 may be in the stowed configuration, in which the standards may extend along the support surface 64 and/or along platform members 208, 210. Similarly, when shell members 24, 26 and the pop-up structure 62 are in the open configuration, standards 310 may extend transversely from the shell members and/or from the support surface 64.

Figure 15:
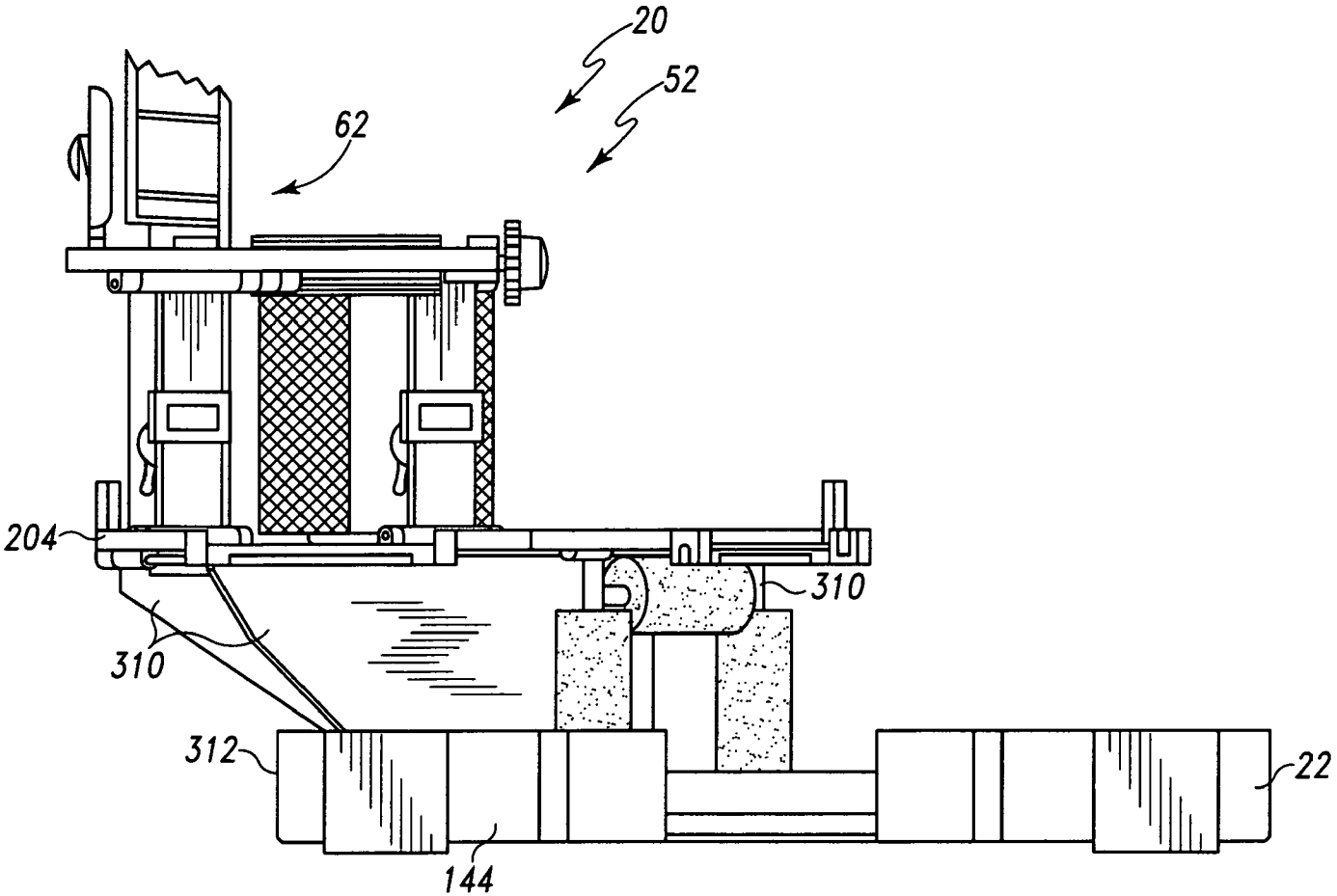
FIG. 15 is a side partial view of the playset of FIG. 2 in an open configuration.

The coupling of standards 310 to shell 22 may define a standard axis that forms an acute angle with shell hinge axis 30 and/or one or more components of shell perimeter 144, such as back wall 312. For example an angle of 45 degrees may be used. As illustrated in FIG. 15, platform 204 may be configured such that at least a portion of the platform extends outside of shell perimeter 144 when the pop-up structure is in the deployed configuration. In some illustrative examples, shell hinge axis 30 may be substantially parallel to platform hinge axis 212, as can be seen in FIGS. 2-6.

Figure 16:
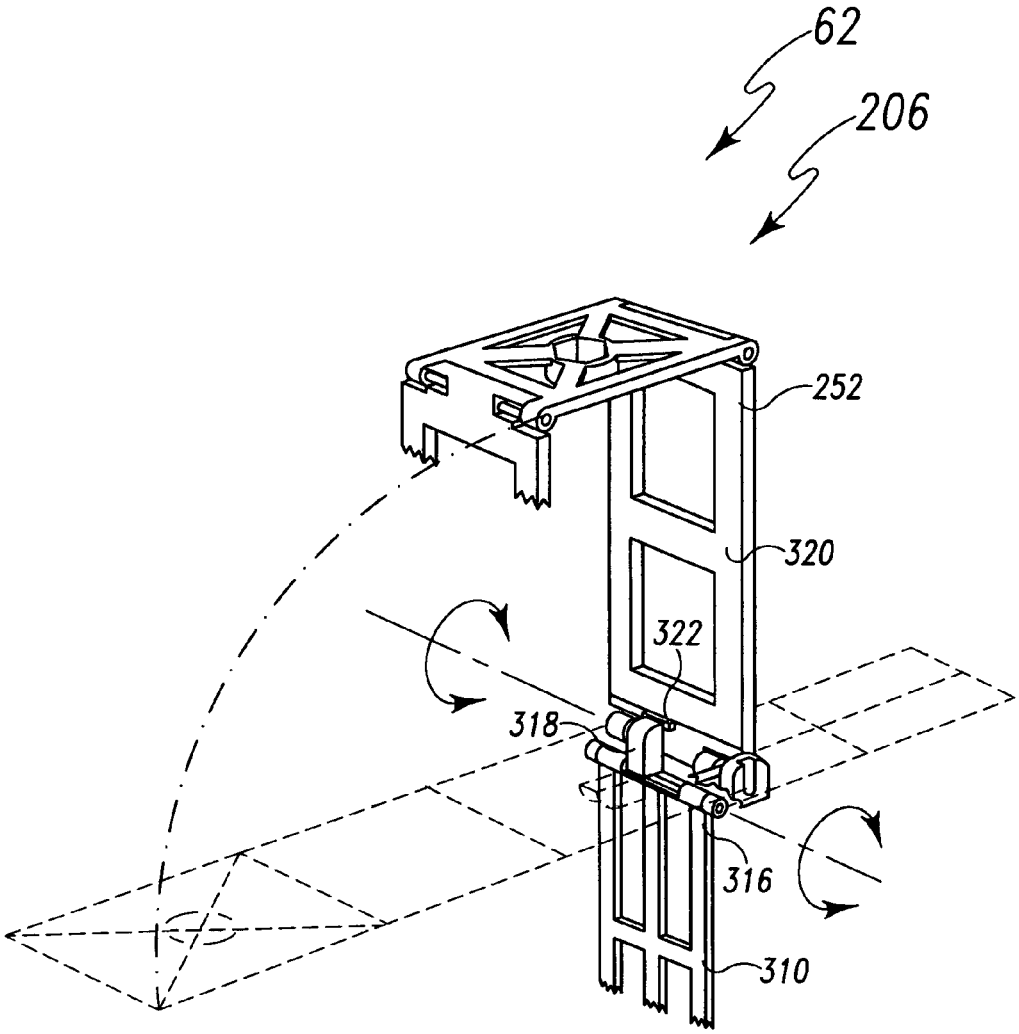
FIG. 16-17 are cutaway perspective partial views of illustrative examples of assemblies of pop-up structures.
Figure 17:
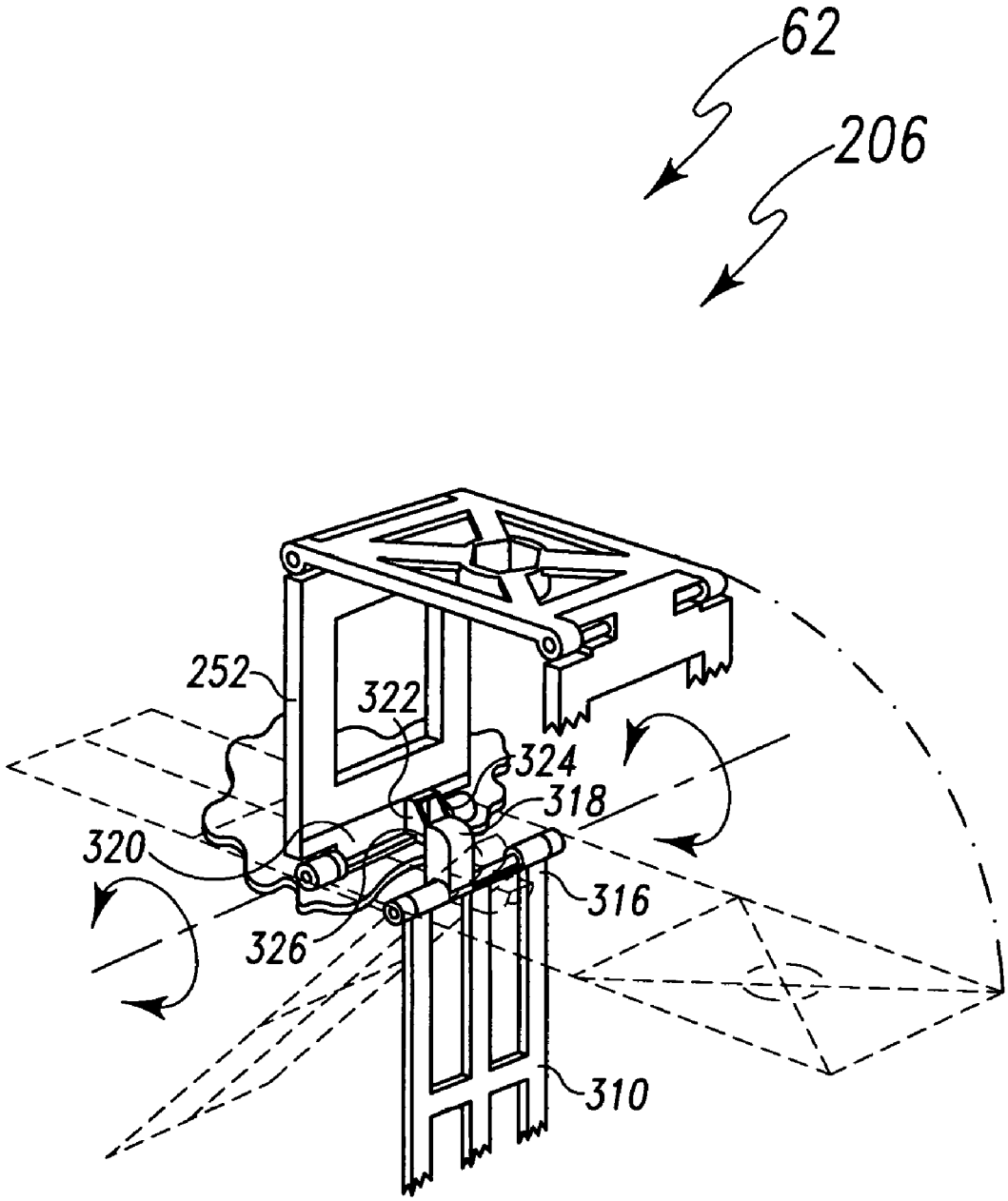

Turning now to FIGS. 16-17, pop-up structures 62 may include one or more elements that urge the pop-up structure itself, or various subcomponents such as one or more erect assemblies 206 toward the deployed or erect configuration. For example, standards 310 may be adapted to urge erect assembly 206 toward the erect configuration. For example, the top end 316 of one or more standards may include a tab 318 that is adapted to press against at least one erect assembly element 252. In some examples, the at least one erect assembly element may have a surface 320 and a projection 322 from the surface. The projection may be aligned with the tab, as shown in FIGS. 16-17, and may have any suitable profile. For example, FIG. 16 shows a first profile for projection 322 in which tab 318 is adapted to urge erect assembly 206 directly toward the erect configuration. In contrast, FIG. 17 shows a second profile for projection 322 that urges the erect assembly to an intermediate erect position as tab 318 presses against sloped face 324, and to a fully erect position as tab 318 presses against vertical face 326. In some illustrative examples, tab 318 may be formed from a resilient material.

Figure 18:
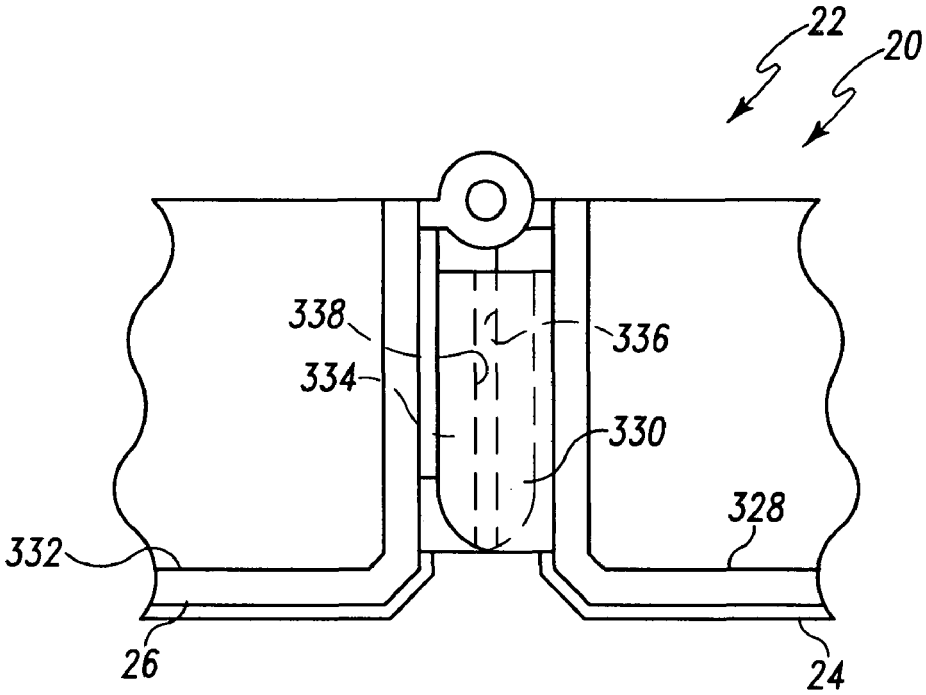
FIG. 18 is a side partial view showing an illustrative example of a first shell member with a first latch element and a second shell member with a second latch element in an open position.
Figure 19:
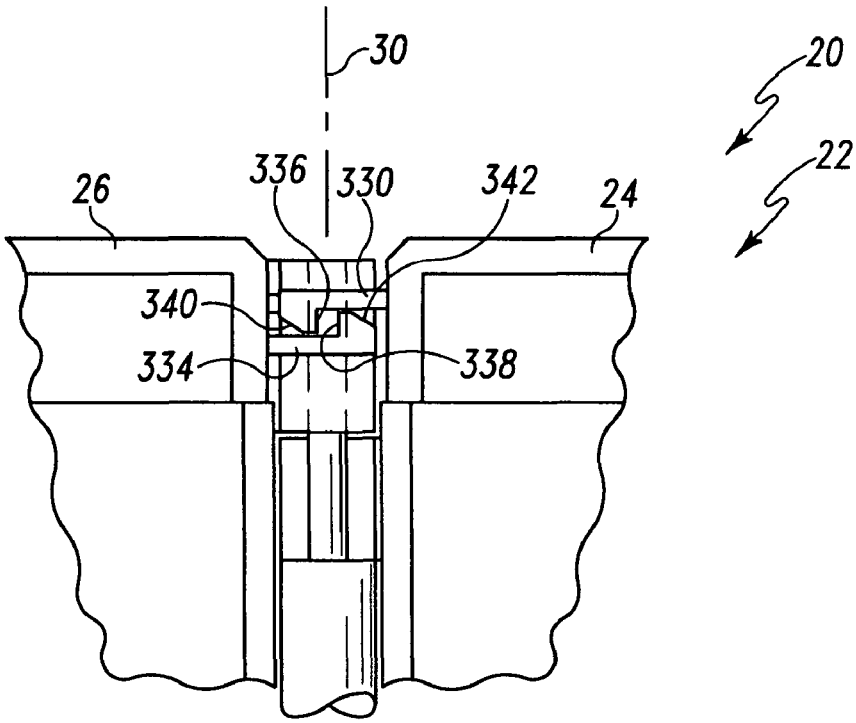
FIG. 19 is a bottom partial view of the playset components shown in FIG. 18.

Turning now to FIGS. 18-19, a portion of playsets 20 is shown. The first shell member 24 may include a first surface 328 and a first latch element 330. Similarly, second shell member 26 may include a second surface 332 and a second latch element 334. As has been discussed previously, the second shell member may be movable relative to the first shell member between the closed position in which the first surface faces the second surface, and an open position in which the surfaces face a common direction. In some illustrative examples, the second latch element may engage the first latch element when the second latch element is in the open position, thereby retaining the second shell member in the open position. Playset 20 may include any number of second latch elements that each pair-wise engage a corresponding first latch element. For example, two latch element pairs may be used.

As shown in FIGS. 18-19, first latch element 330 has a first edge 336 and second latch element has a second edge 338 that may be adapted to engage the first edge when the second latch element engages the first latch element. The first latch element may have a first sloped face 340 and the second latch element may have a second sloped face 342. When the second shell member is moved to the open position, the first sloped face may be adapted to abut the second sloped face and to oppose the bias on the second latch element. In some illustrative examples, the second latch element may be biased towards the first latch element and/or may be formed from a resilient material. In other illustrative examples, the first latch element may be formed integrally with at least a portion of shell hinge 28. When the playset is transitioned from the open position, the second edge may be adapted to abut the first edge and to oppose the bias on the second latch element to release the engagement between the latch elements.

Figure 39:
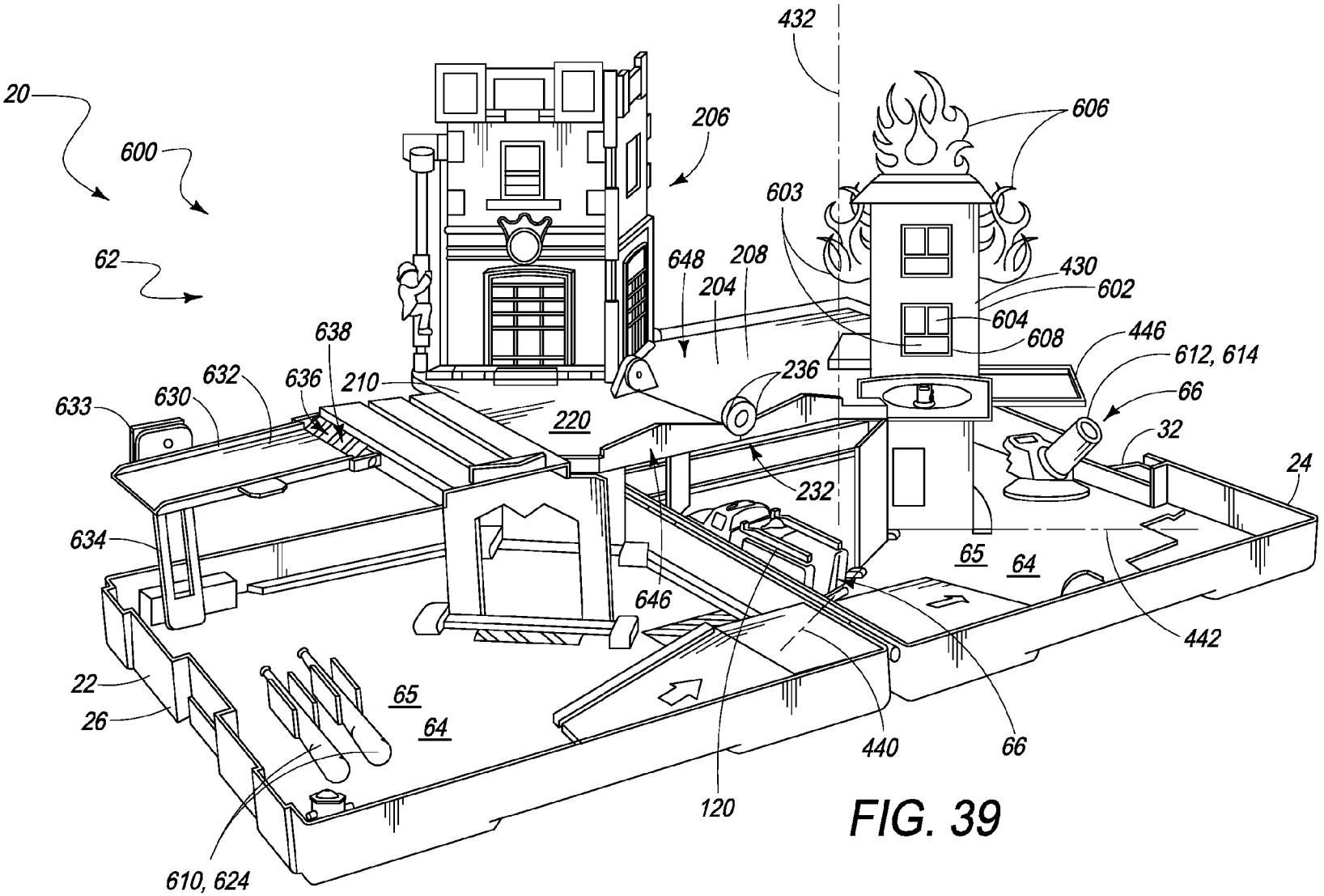
FIGS. 39-43 are perspective views of another illustrative example of a playset, shown in an open configuration.
Figure 40:
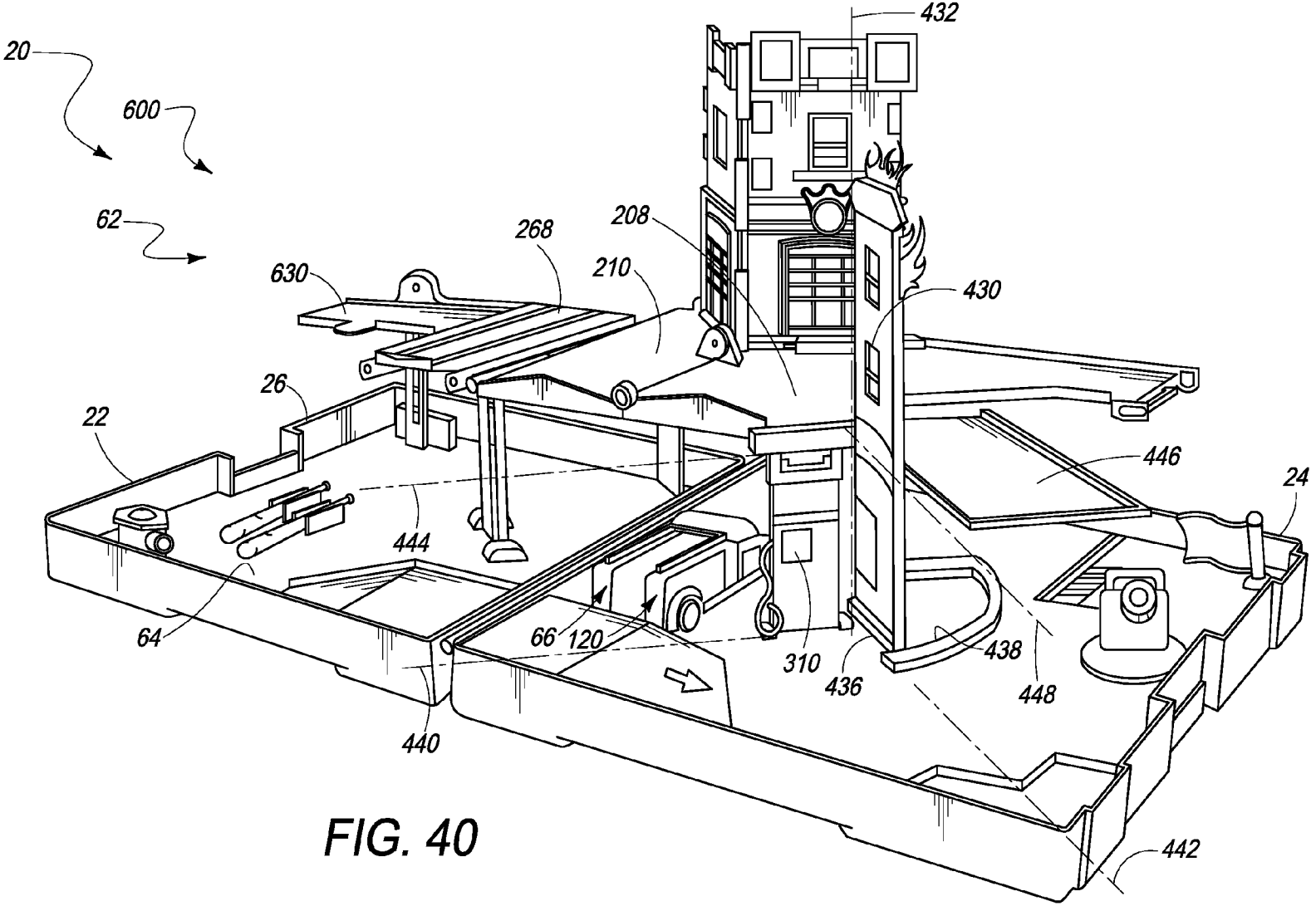

In some illustrative examples, the playset 20 may include at least one rotating member 430, as shown in a playset 400 in FIG. 20 and a playset 600 in FIG. 39. Playsets 400 and 600 may include features similar to features disclosed in previously described playsets, which features are given the same reference numbers. In these examples, the pop-up structure 62 may be configured such that the rotating member 430 may be selectively rotated, as indicated by arrow 431, relative to the support surface 64 and about a rotation axis 432 that may be transverse to the support surface 64, as shown in FIGS. 20-28, 35, 38-43, and 50. For example, at least a portion of the rotating member 430, such as at least one sliding element 434, as shown in FIG. 20, or a foot 436, as shown in FIG. 40, may be configured to move and/or slide along a track 438 disposed on the support surface 64. The track 438 may have an arcuate configuration that may be centered on the rotation axis 432, as shown in FIGS. 20, 28, 40 and 42. Playsets 400 and 600 may also be configured to allow movement of member 430 along a track having a different shape, such as a varying curve, a straight line, or other regular or irregular shape.

As is generally shown in FIGS. 20-28, 35, 38-43, and 50, the indicated standard 310, which may be a first member, and the rotating member 430, which may be a second member, may each be hingedly coupled to the support surface 64. For example, the indicated standard 310 may be configured to pivot about a first hinge axis 440 when the pop-up structure 62 is transitioned between a stowed configuration, in which the standard 310 may extend along the support surface 64 and/or the platform members 208, 210, and a deployed configuration, in which the standard 310 may extend transversely from the support surface 64.

Similarly, rotating member 430 may be configured to pivot about a second hinge axis 442 when the pop-up structure 62 is transitioned between the stowed configuration, in which the rotating member 430 may extend along the support surface 64 and/or the platform members 208, 210 (as shown in FIG. 30), and the deployed configuration, in which the rotating member 430 may extend transversely from the support surface 64. In some illustrative examples, at least one of the indicated standard 310 and the rotating member 430 may be normal or perpendicular to the support surface 64 when the pop-up structure 62 is in the deployed configuration, as shown in FIGS. 20-28, 35, 38-43, and 50. In some illustrative examples, transitioning the pop-up structure 62 between the stowed and deployed configurations may cause the rotating member 430 to transition between the stowed and deployed configurations. In some illustrative examples, the rotating member 430 may be configured to be selectively manually transitioned between the stowed and deployed configurations.

In some illustrative examples, the pop-up structure 62 may be configured such that rotation of the rotating member 430 into certain positions relative to the pop-up structure 62 and/or the support surface 64 may preclude transitioning the pop-up structure 62 from the deployed configuration to the stowed configuration.

As may be seen in FIGS. 20-28, 35, 38-43, and 50, rotation of the rotating member 430 about the rotation axis 430 also rotates the second hinge axis 442 relative to the first hinge axis 440. In particular, the rotating member 430 may be rotated into an orientation in which the second hinge axis 442 is parallel to the first hinge axis 440, as shown in FIG. and 42. The rotating member 430 may also be rotated into an orientation in which the second hinge axis 442 is transverse to the first hinge axis 440 when viewed in a plane containing the second axis 442, as shown in FIGS. 20-21, 23-28, 39-41, and 43. With reference to the second hinge axis 442 being "transverse to the first hinge axis 440 when viewed in a plane containing the second axis 442," it is meant that the first and second hinges axes 440, 442 are not parallel such that the two axes are either skew, if the two axes are not in a common plane, or intersecting, if the two axes are in a common plane.

Figure 42:
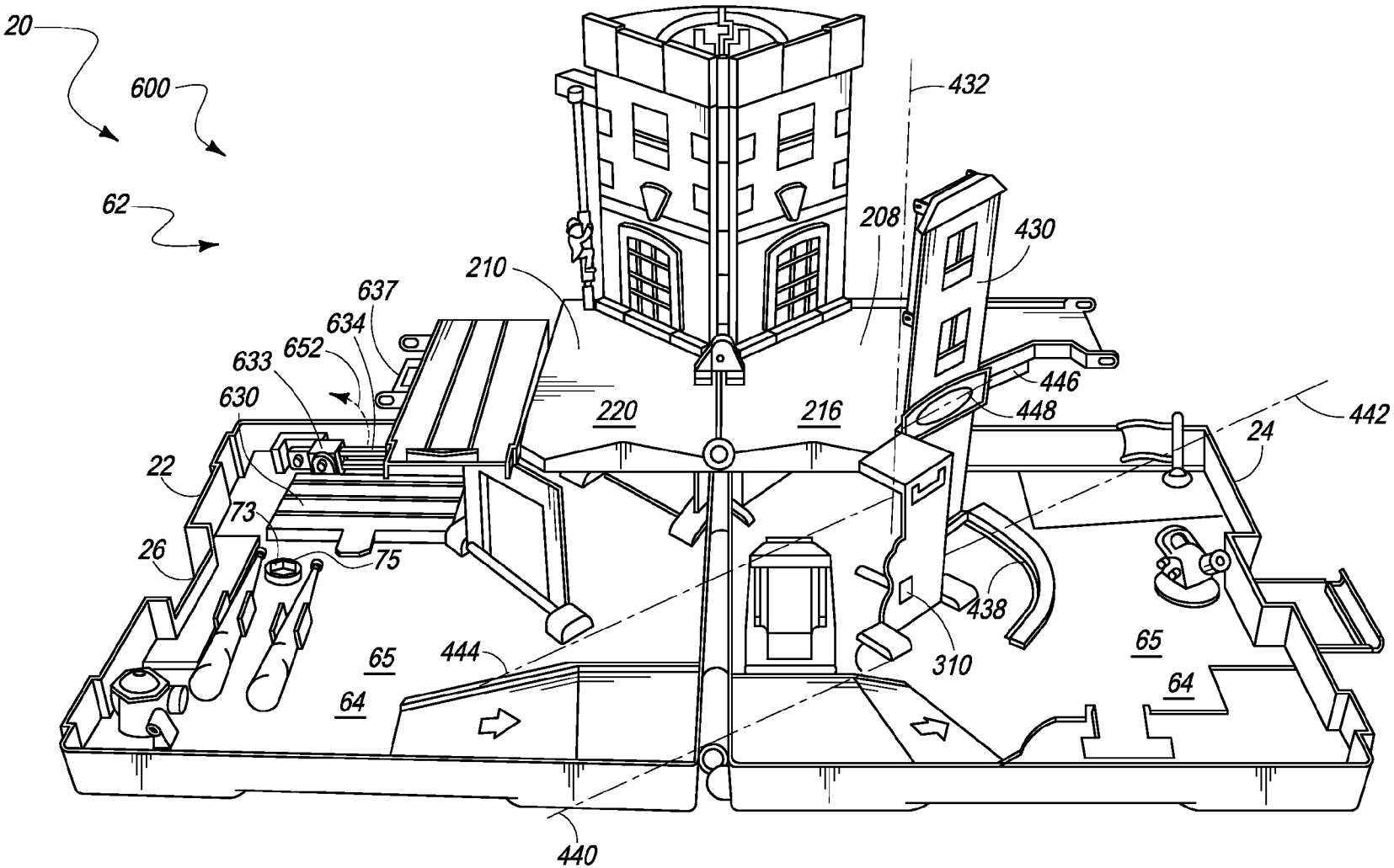

Orientation or rotation of the rotating member 430 such that the second hinge axis 442 is oriented transversely to the first hinge axis 440 when viewed in a plane containing the second axis 442 may preclude transitioning the pop-up structure 62 between the deployed configuration and the stowed configuration. Thus, the rotating member 430 is oriented to permit transitioning the pop-up structure 62 between the deployed configuration and the stowed configuration when the first and second hinge axes 440, 442 are parallel, as shown in FIG. 42. Conversely, the rotating member 430 is oriented to preclude transitioning the pop-up structure 62 between the deployed configuration and the stowed configuration when the first and second hinge axes 440, 442 are not parallel, as shown in FIG. 40.

With reference to FIGS. 40 and 42 and as discussed above, the pop-up structure 62 may include a first platform member 208, which may be hingedly coupled to the indicated standard 310 and spaced from the support surface when the pop-up structure 62 is in the deployed configuration. As shown in FIGS. 40 and 42, the first platform member 208 may be configured to pivot relative to the indicated standard 310 about a third axis 444, which may be parallel to the first hinge axis 440. When the first and third hinge axes 440, 444 are parallel, the first platform member 208 may be maintained substantially parallel to the support surface, such as when the pop-up structure 62 is transitioned between the deployed configuration and the stowed configuration.

Figure 21:
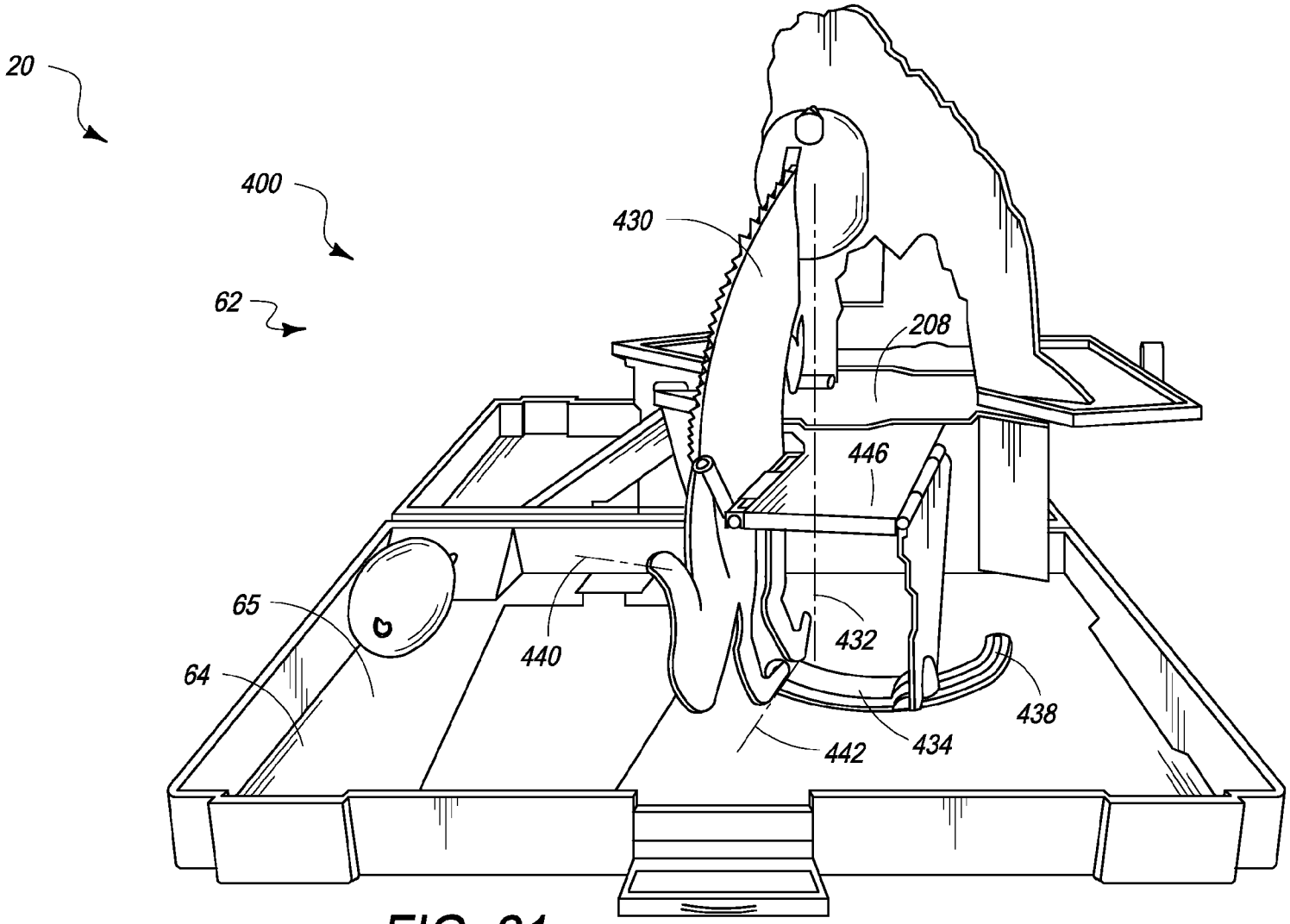
Figure 22:
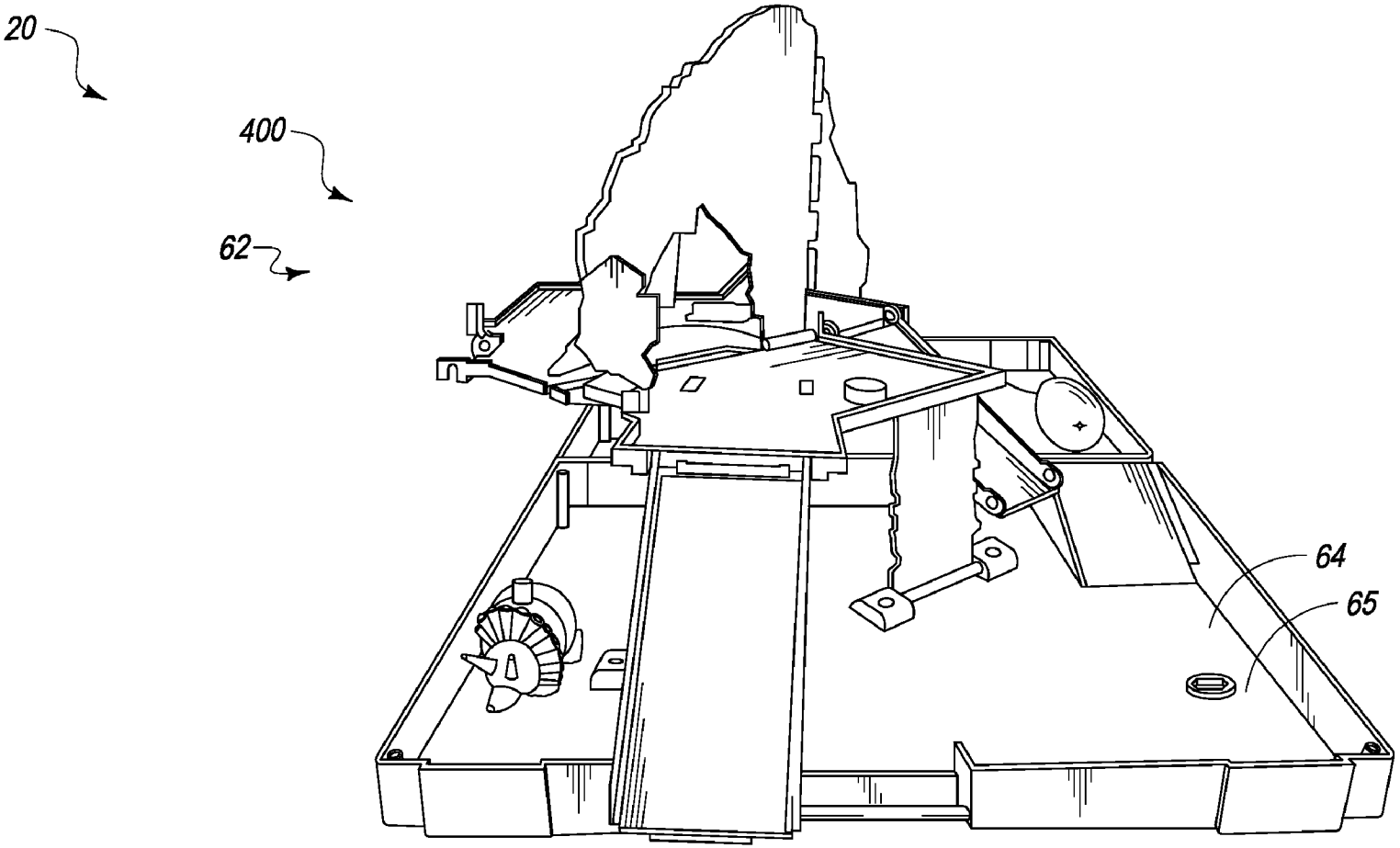
Figure 23:
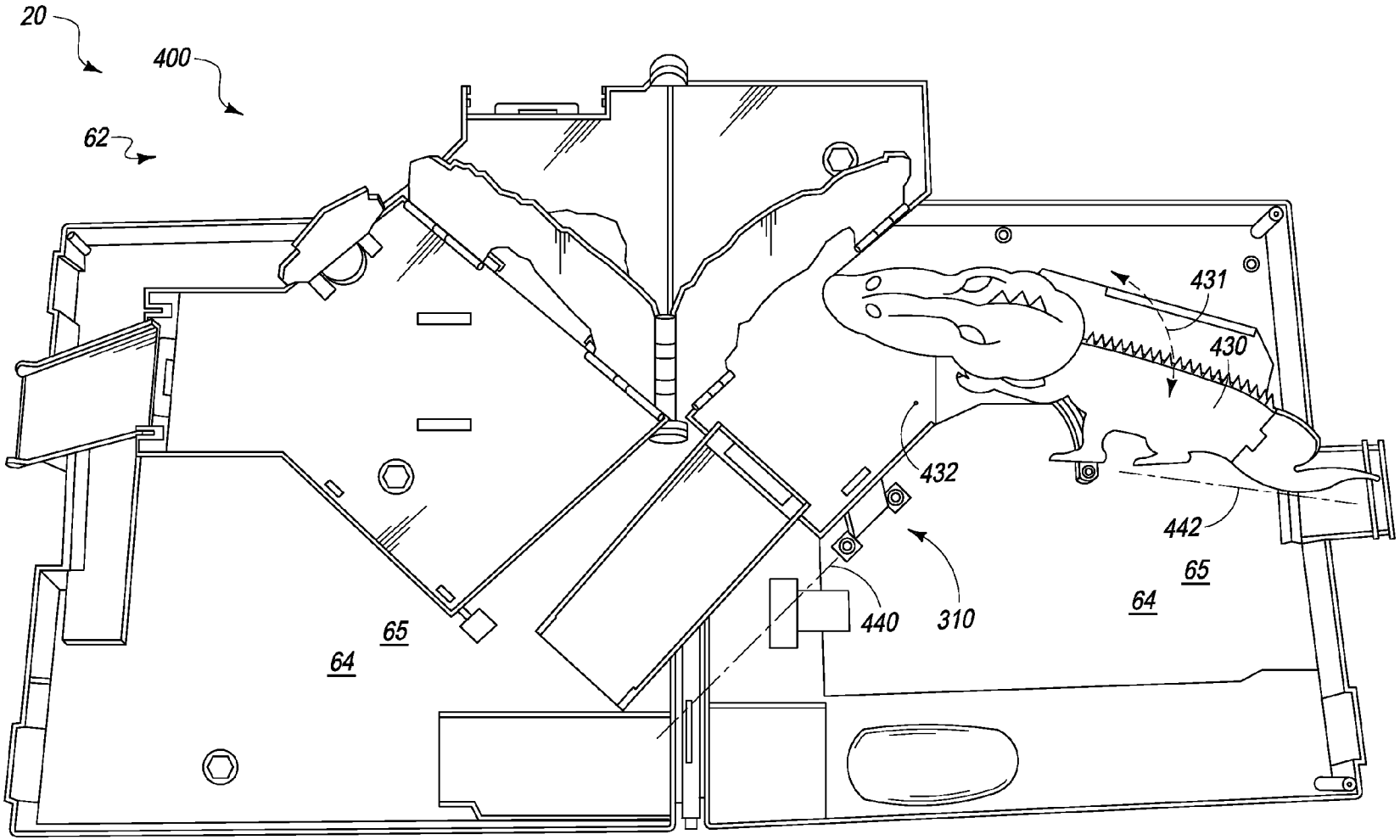
Figure 24:
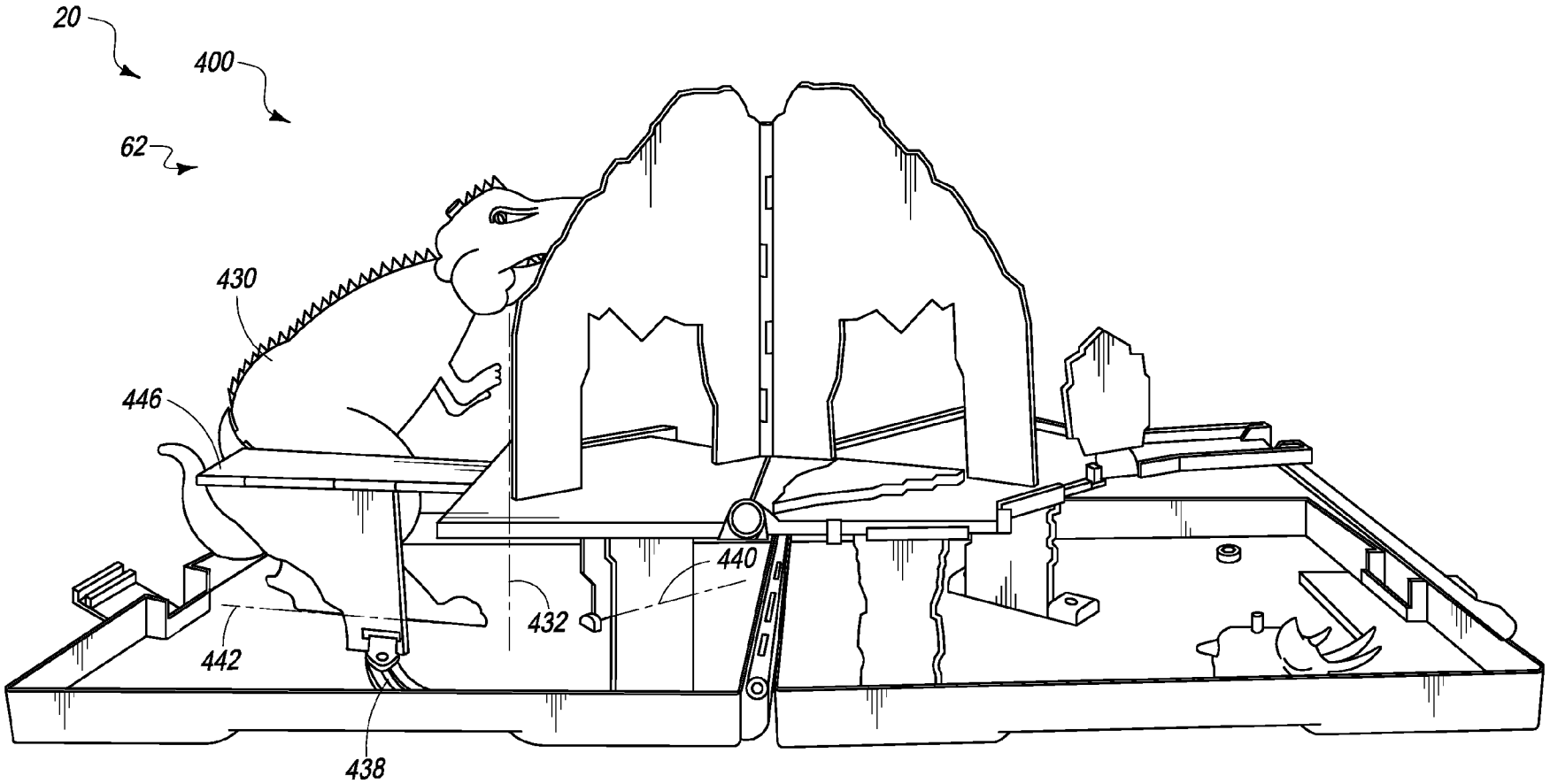
Figure 25:
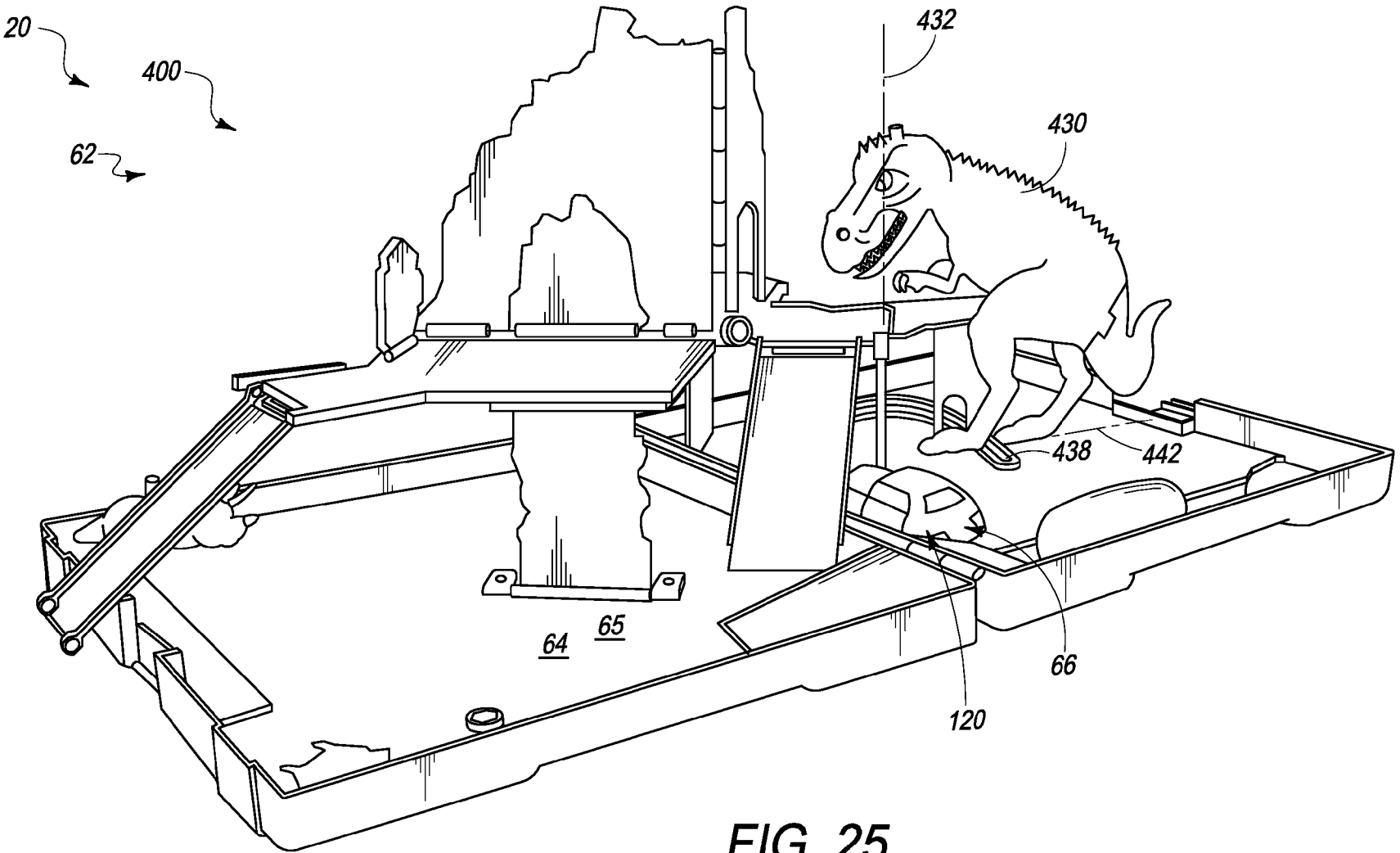
Figure 26:
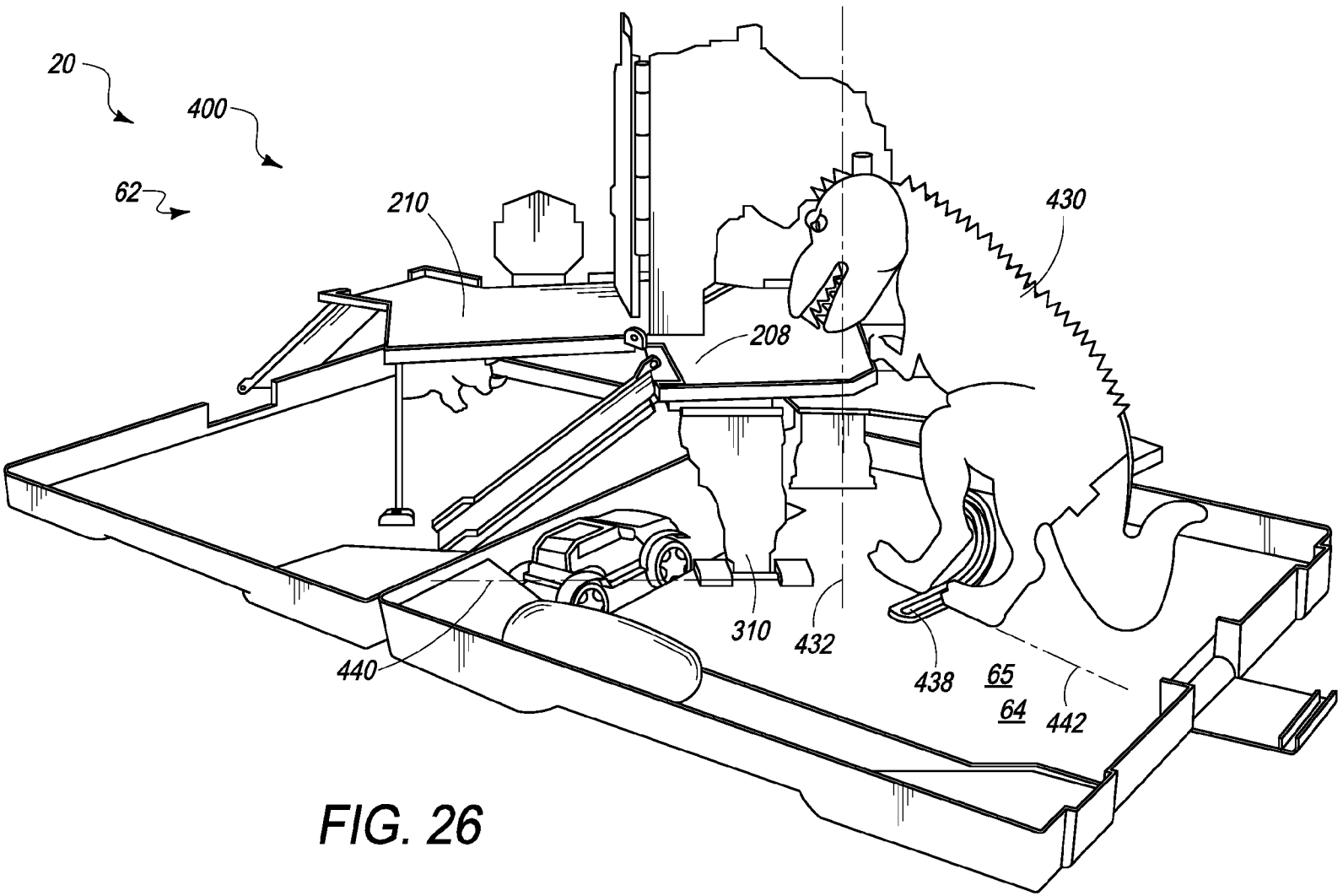
Figure 27:
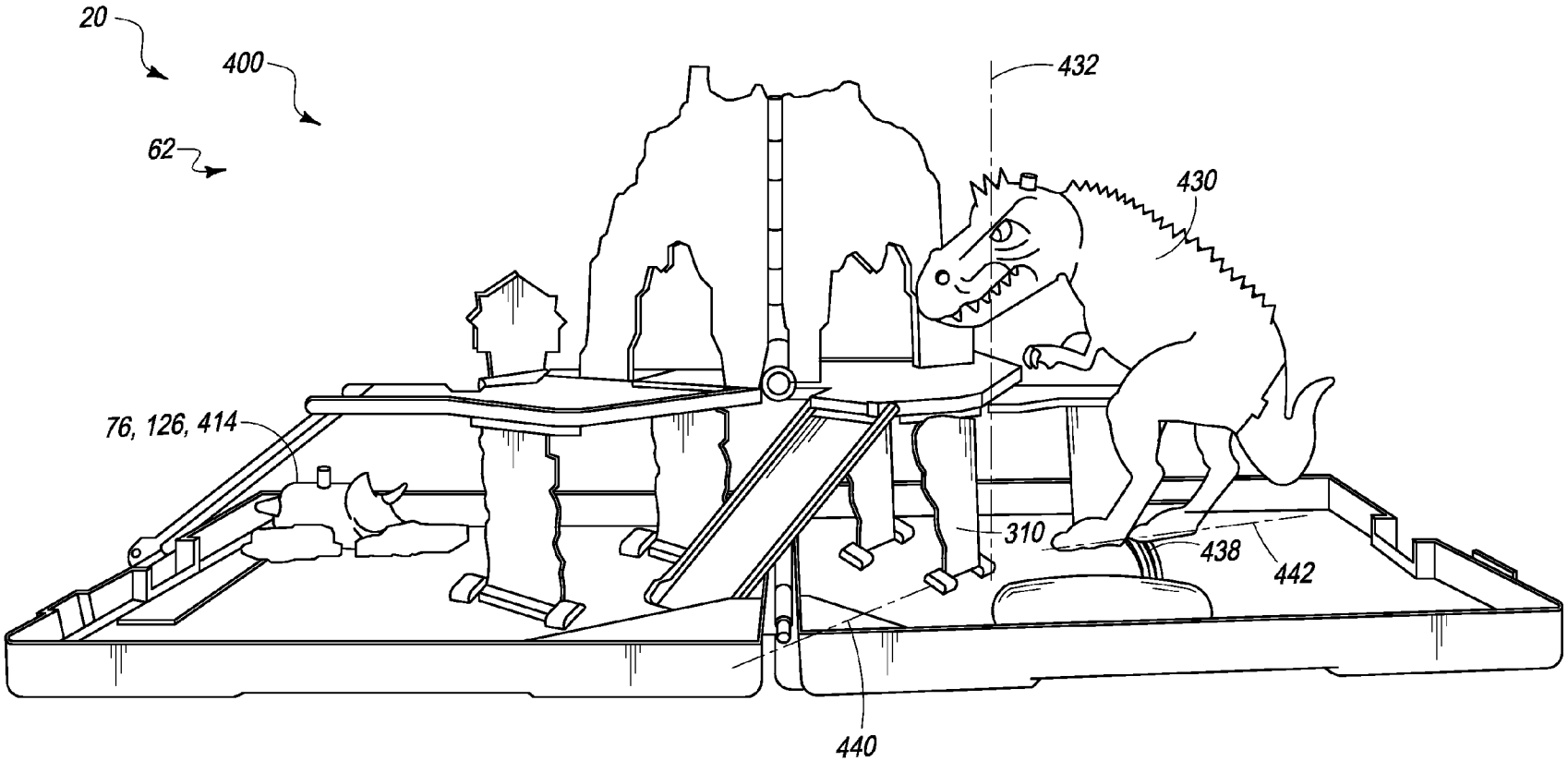
Figure 28:
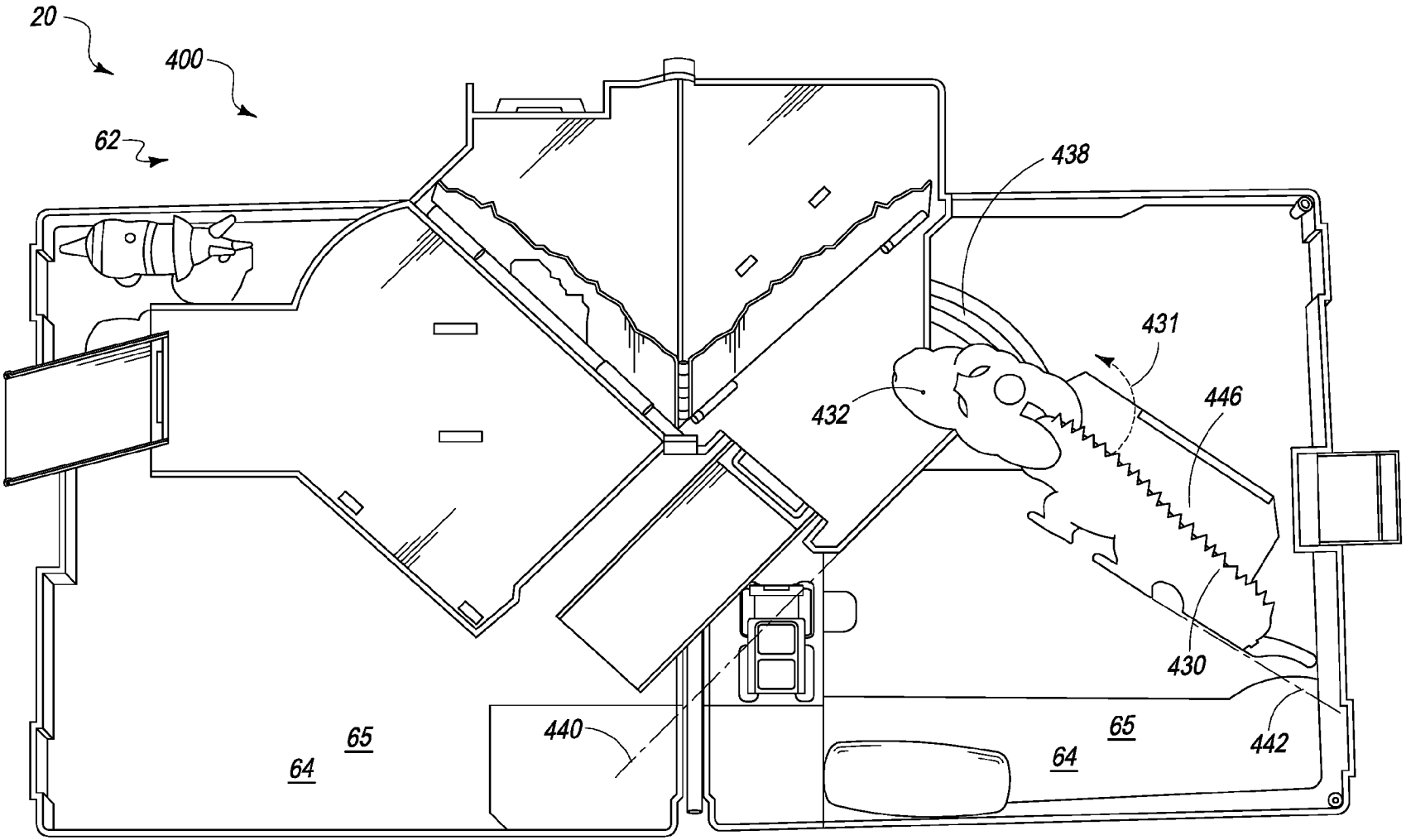
Figure 29:
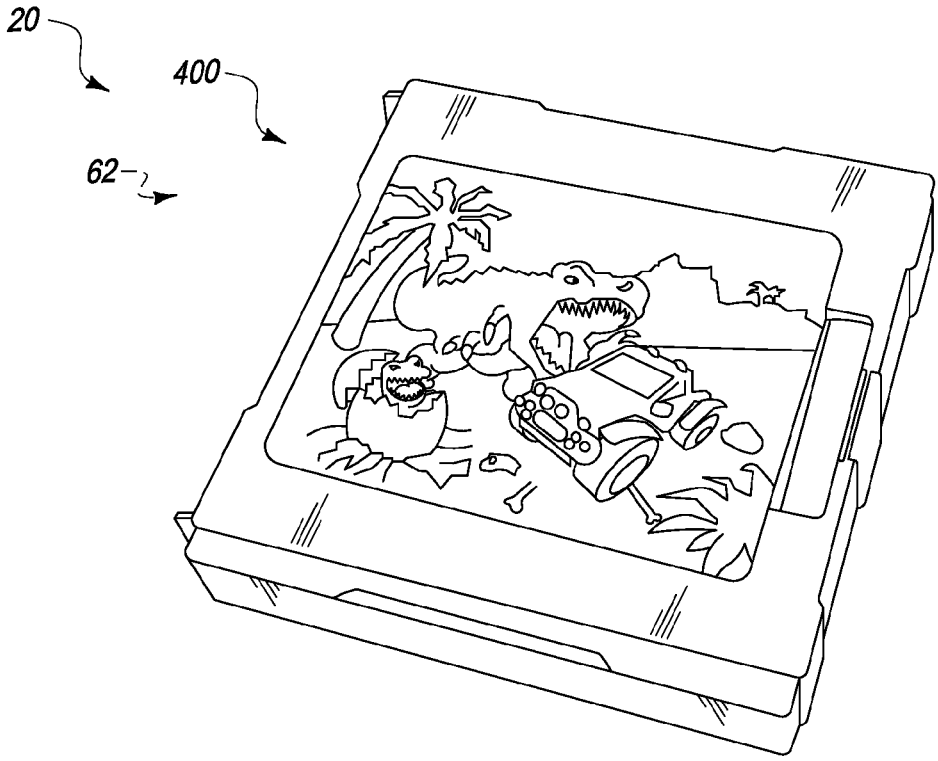
FIG. 29 is a perspective view of the playset of FIGS. 20-28, shown in a closed configuration.
Figure 43:
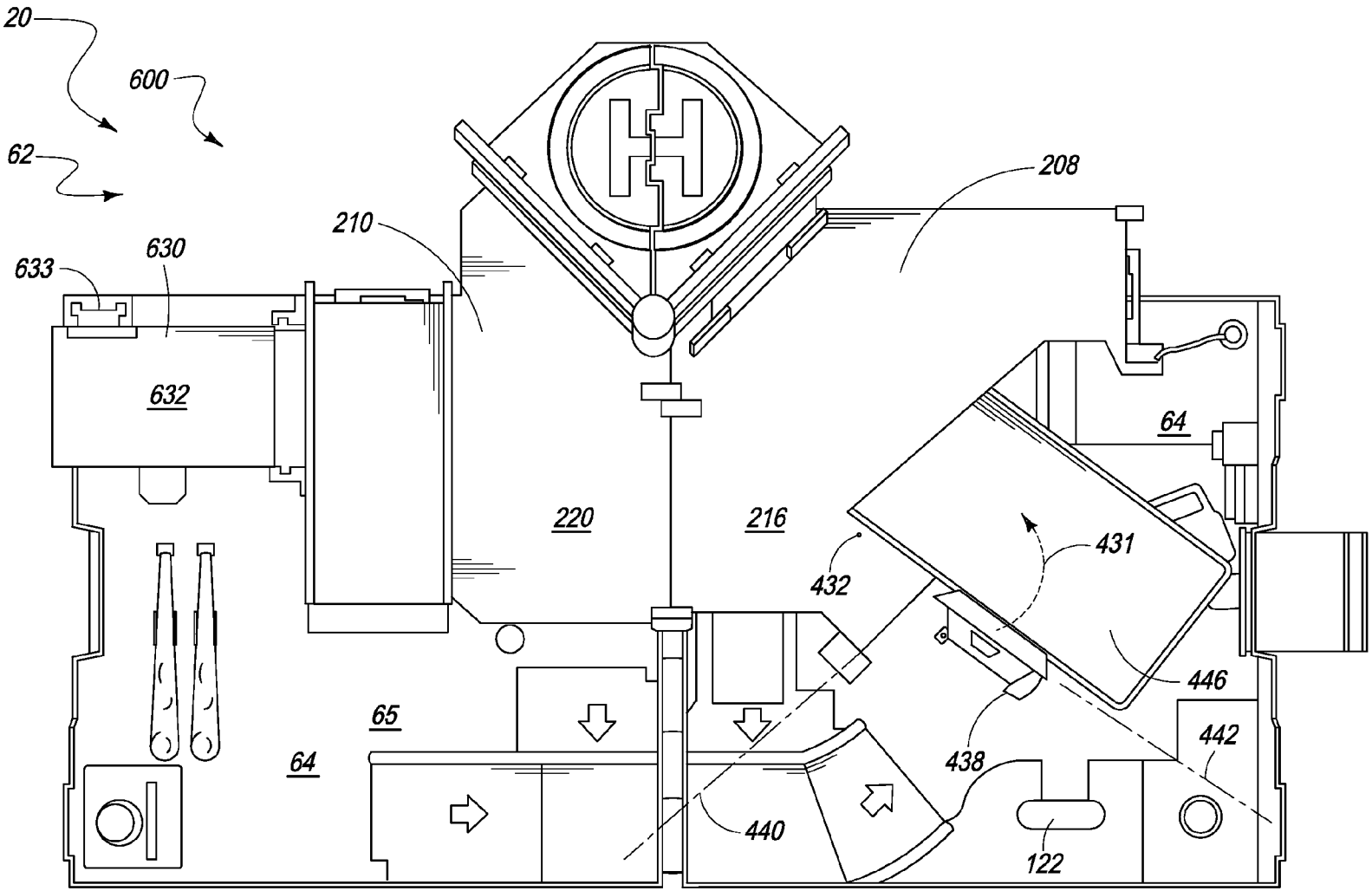
Figure 44:
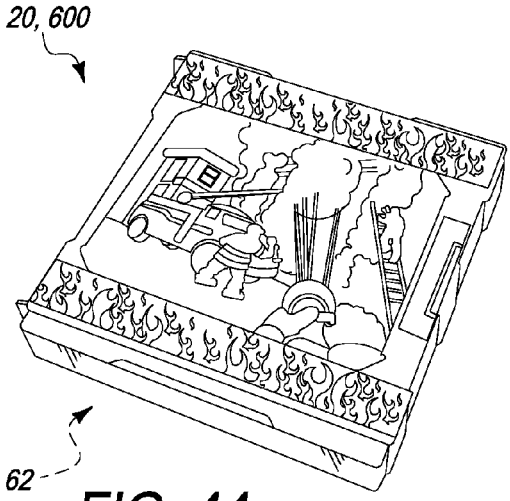
FIG. 44 is a perspective view of the playset of FIGS. 39-43, shown in a dosed configuration.
Figure 47:
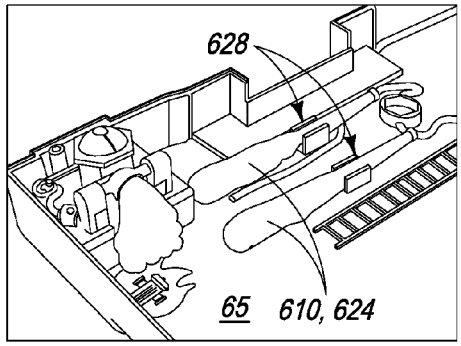
FIGS. 45-49 are perspective partial views showing illustrative examples of functionalities and accessories for a playset, such as the playset of FIGS. 39-43.

In some illustrative examples, the pop-up structure 62 may include an auxiliary platform 446. The auxiliary platform 446 may be hingedly coupled to the rotating member 430 such that the auxiliary platform 446 may be configured to pivot about a fourth hinge axis 448, which may be parallel to the second hinge axis 442, as shown in FIGS. 40 and 42. The auxiliary platform 446 may also be configured to rotate about the rotation axis 432 when the rotating member 430 is rotated about the rotation axis 432, as suggested by arrow 431 in FIGS. 23 and 43. For example, the auxiliary platform 446 may be pivotably connected to the first platform member 208, as suggested in FIG. 50. In some illustrative examples, the auxiliary platform 446 may form a continuous or discontinuous surface with the first platform member 208, as shown in FIGS. 21, 40 and 43.

In some illustrative examples, rotating member 430 may further illustrate the theme of the playset, such as by appropriate decoration or the inclusion of appropriate functionality. For example, as shown in FIGS. 20-38, the rotating member 430 may have the appearance of a dinosaur. In some illustrative examples, such as depicted in FIGS. 20 and 35-37, the rotating member 430 may include one or more parts that may be adapted to move relative to each other. For example, the rotating member 430 may include a tail 450 and a head 452 that may be pivotably coupled to a body 454 of the dinosaur.

Figure 35:
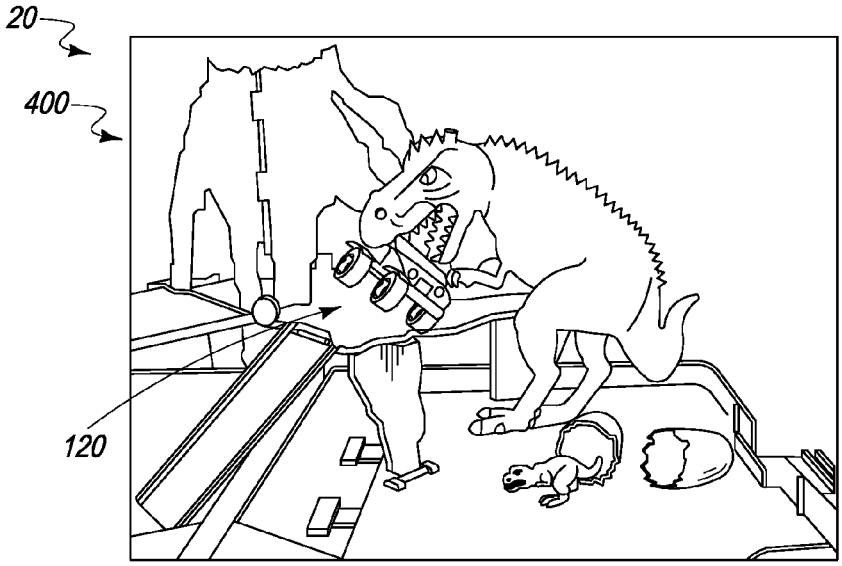
FIGS. 35-37 provide an illustrative example of an optional functionality for the playset of FIGS. 20-28.
Figure 36:
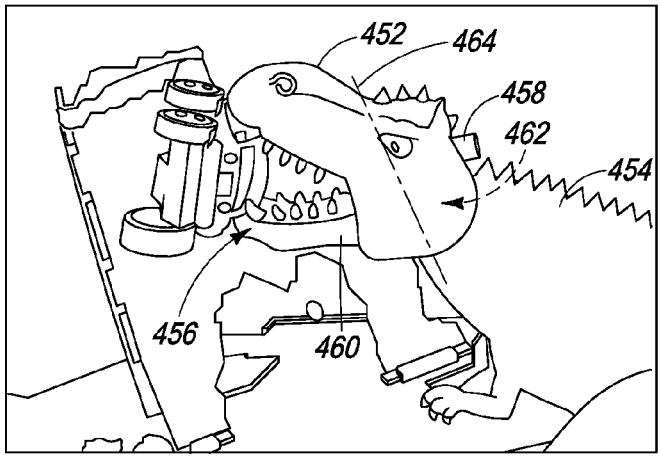
Figure 37:
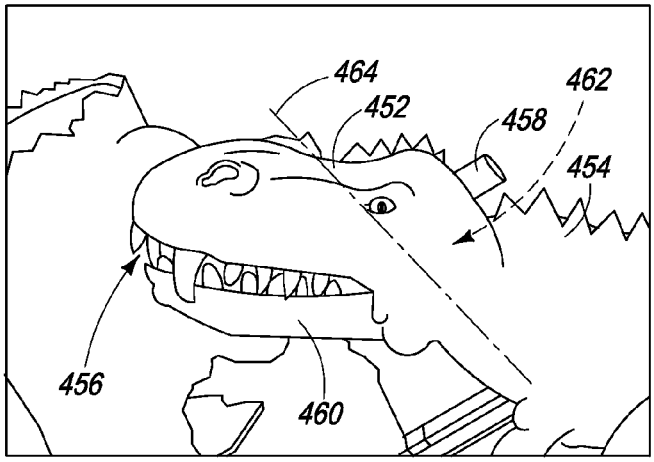

In some illustrative examples, the head 452 may include a mouth 456 that may be adapted to be selectively transitioned between open and closed configurations, as shown in FIGS. 35-37. Accordingly, the rotating member 430 may include an actuator 458, which may be on the head 452 or body 454, that is coupled to a jaw 460 via an appropriate linkage 462. The linkage 462 may include gears, cams, biasing elements, and other devices that may be adapted to translate linear motion of actuator 458 to rotational motion of jaw 460 about a jaw axis 464. Mouth 456 may be biased toward the closed position such as to retain an accessory such as a vehicle 120, as shown in FIGS. 35-36.

As an additional illustrative example of thematic illustration, the rotating member 430 may have the appearance of a burning building 602 and the playset may include an appropriate accessory 66 such as a projectile launcher 612 that is configured to resemble a simulated water cannon 614, as shown in FIGS. 39-50. The projectile launcher 612 may be configured to be retained, such as releasably or removably, by a suitable mount, such as one of the accessory mounting apertures 73 or projections 75, which may be disposed on at least one of the interior surfaces 65 of the first and second shell members 24, 26. By "removably," it is meant that, even though the retaining component is capable of optionally permanently retaining the retained component, the retained component may optionally be repeatedly retained by and/or removed from the retaining component without permanent and/or destructive alteration to the retaining component, the retained component, and/or the engagement therebetween.

Figure 48:
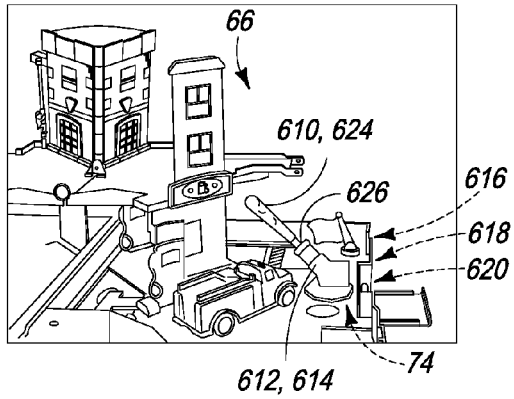
Figure 46:
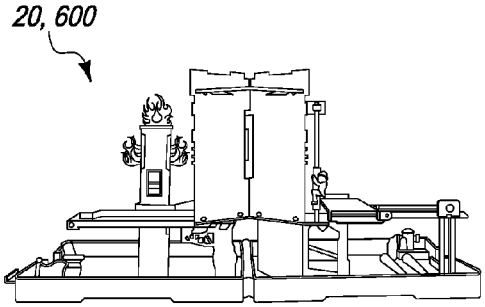
Figure 49:
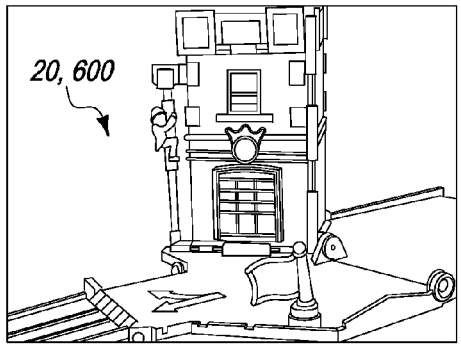
Figure 50:
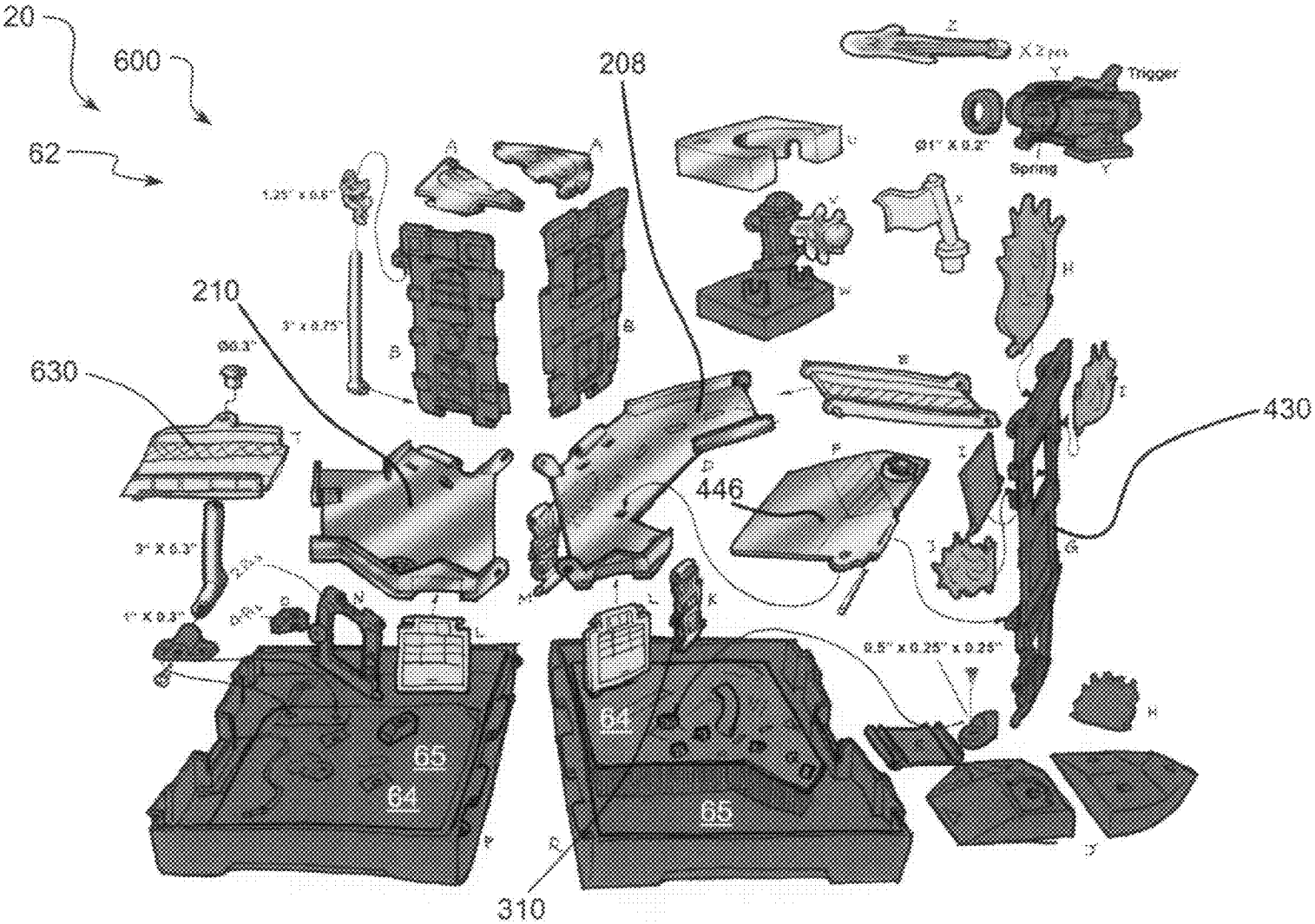
FIG. 50 is an exploded view of an illustrative example of a playset such as the playset of FIGS. 39-43.

In some illustrative examples, the projectile launcher 612 may be configured to receive, retain and selectively ballistically project at least one projectile 610. When used with a burning building or firehouse theme, the projectile 610 may be configured to simulate a water blast 624 that has been expelled from the water cannon 614, as shown in FIG. 48. By "ballistically project," it is meant that the projectile travels freely once it has been ejected, expelled, or projected from the projectile launcher 612. The projectile launcher 612 may include an ejecting mechanism 616, which may include one or more biasing elements 618 such as a spring, a trigger 620, and an aperture 626 in and/or from which the projectile 610 may be received, retained and projected. In order to enhance the simulation that the projectile 610 is a water blast 624, projectile 610 may be fabricated from a translucent plastic or other suitable material.

In some illustrative examples, the playset 20 may include at least one projectile retainer configured to releasably retain or store at least one projectile 610. For example, as shown in the illustrative example presented in FIG. 47, playset 20 may include at least one set of clips 628 disposed on at least one of the interior surfaces 65 of the first and second shell members 24, 26.

When the rotating member 430 is configured to resemble a burning building, as shown in FIGS. 39 and 48, the rotating member 430 may include one or more target elements 603 towards which the projectile launcher 612 may be selectively aimed. When the projectile launcher 612 is selectively aimed towards at least one of the target elements 603, the projectile launcher 612 may be configured to project a projectile 610 toward the selected target element 603.

Each of the target elements 603 may be pivotable relative to the pop-up 62 structure when the pop-up structure 62 is in the erect configuration. In some illustrative examples, the target elements 603 may be pivotable relative to the rotating member 430. The target elements 603 may be configured to transition from a first or deployed position toward a second or stowed position, such as when the target element 603 is struck by the at least one projectile 610 while the target element 603 is in the first or deployed position. Nonexclusive illustrative examples of suitable target elements 603 may include rotating windows 604 and flame members 606, as shown in FIGS. 39-50. The rotating windows 604 may be rotatable within frames 608 that are disposed on the rotating member 430. The flame members 606 may be hingedly or pivotably attached to the rotating member 430. The flame members 606 may be in a first or deployed position when the flame members 606 extend beyond the rotating member 430, as shown in FIGS. 39 and 48, and the flame members 606 may be in the second or stowed position when the flame members 606 are folded behind the rotating member 430. These target elements may then rotate about axes that are at least partially transverse to a travel path of the projectile to facilitate movement of the target element between the deployed and stowed positions.

In some illustrative examples, the playset 20 may include at least one movable or lift platform 630, as shown in FIGS. 39-50. The lift platform 630 may be coupled to the support surface 64 independently of the pop-up structure 62. The lift platform 630 may be adapted to be selectively transitioned between a first position proximate the support surface 64, as shown in FIG. 42, and a second position spaced from the support surface 64, as shown in FIGS. 39-41, 43, 45-46, and 49. In the first position, at least a first portion of the surface 632 of the lift platform 630 may be disposed proximate the support surface 64, as shown in FIG. 42. In the second position, at least a second portion of the surface 632 of the lift platform 630 may be disposed proximate the surface of at least one of the first and second platform members 208, 210. For example, at least a second portion of the surface 632 of the lift platform 630 may be disposed proximate the surface 220 of the second platform member 210 when the lift platform 630 is proximate the second platform member 210. With respect to the first and second portions of the surface 632 of the lift platform 630, it should be understood that the first and second portions may be the same portion or different portions of the surface 632, and these portions may be discrete or may overlap.

In some illustrative examples, the surface 632 of the lift platform 630 may be aligned with the surface 220 of the second platform member 210 when the lift platform 630 is in the second position. For example, the surface 632 of the lift platform 630 may form a substantially continuous surface with the surface 220 of the second platform member 210 when the lift platform 630 is in the second position. In some illustrative examples, such as where the surfaces 632 and 220 are at least partially planar, the surface 632 of the lift platform 630 may be coplanar with the surface 220 of the second platform member 210 when the lift platform 630 is in the second position.

In some illustrative examples, the second platform member 210 may include an edge 636 that may be configured to at least partially support a first end 638 of the lift platform 630 when the lift platform 630 is in the second position, as suggested in FIG. 39. For example, the edge 636 may include a slot 637, as shown in FIG. 42, that may be configured to receive the first end 638 of the lift platform 630, which may include a tab such as has been generally described above.

Figure 41:
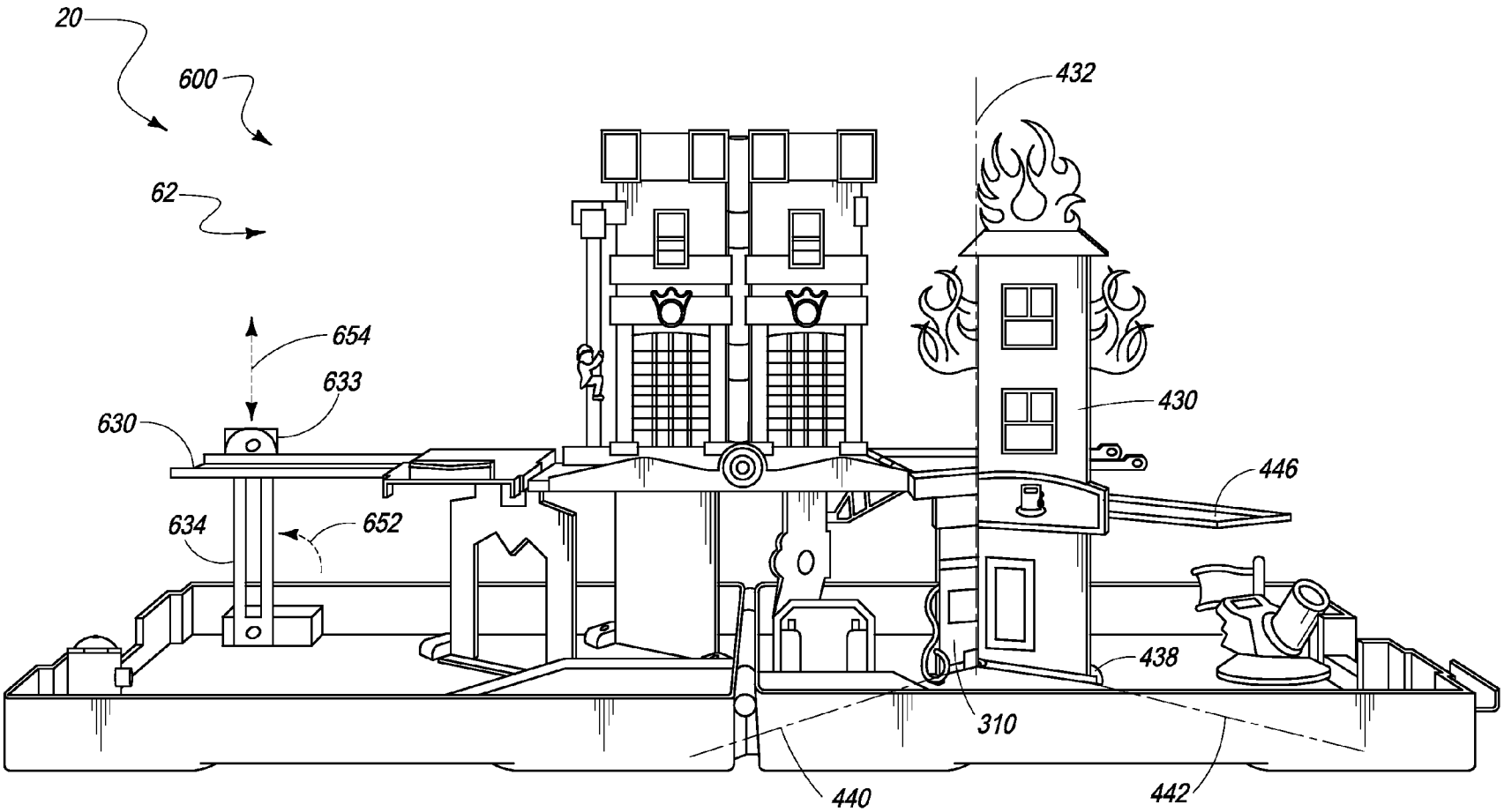
Figure 45:
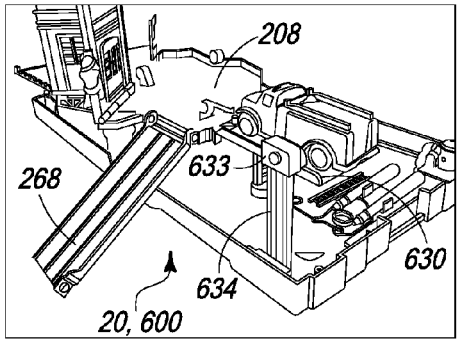

In some illustrative examples, the lift platform 630 may be coupled to the support surface 64 by way of a slider 633 and an arm member 634, as shown in FIGS. 39, 41-43, and 45. The arm member 634 may include a first end that may be pivotably attached to the support surface 64 and a second end opposite the first end. As indicated by arrow 652 in FIGS. 41-42, the arm member 634 may be adapted to be selectively transitioned or pivoted between a lowered position in which the arm member 634 extends along the support surface 64, as shown in FIG. 42, and an elevated position in which the arm member 634 extends transversely from the support surface 64, as shown in FIG. 41. The slider 633, which may be pivotably coupled to the lift platform 630, may be adapted to slide along the arm member 634, as indicated by arrow 654, between a position proximate the first end of the arm member, as shown in FIG. 42, and a position proximate the second end of the arm member 634, as shown in FIGS. 41 and 45. Thus, as shown in FIGS. 41 and 45, the arm member 634 may support the lift platform 630 in the second or raised position when the arm member 634 is in the elevated position and the slider 633 is positioned proximate the second end of the arm member 634.

In some illustrative examples, the lift platform 630 may be coupled to the support surface 64 in a manner allowing the lift platform 630 to be maintained parallel to the support surface 64 while the lift platform 630 is transitioned between its first and second positions. For example, the pivotable attachment of the arm member 634 to the support surface 64 and the pivotable coupling of the slider 633 to the lift platform 630 may permit independent pivoting of these pivotable connections, such as where a user may maintain the lift platform 630 parallel to the support surface 64. In some nonexclusive illustrative examples, rotation of the two pivotable connections may be linked and/or constrained such that the lift platform 630 is maintained parallel to the support surface 64 while the lift platform 630 is transitioned between its first and second positions. For example, an additional arm member and slider arrangement may be provided in which the rotation of the two sliders and/or the rotation of the two arm members may be linked and/or constrained.

In some illustrative examples, the lift platform 630 may be configured to engage the second platform member 210 in more than one location. For example, In such examples, the arm member 634 may be coupled to the support surface 64 via a sliding joint, such as one similar to the track and slider arrangement discussed above with respect to the rotating member 430.

Playsets with pop-up structures may be constructed from any suitable material or materials such as plastic, wood, cardboard, or metal. Various components may be fabricated from different materials, and may be colored and/or decorated with dye, paint, or applied decals to add play value to the playsets.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. A playset, comprising:

a support surface;

a pop-up structure coupled to the support surface and adapted to be selectively transitioned between a stowed configuration and a deployed configuration, where in the stowed configuration the pop-up structure is collapsed and extends along the support surface, and in the deployed configuration the pop-up structure stands substantially transverse to the support surface, the pop-up structure comprising first and second members hingedly coupled to the support surface, wherein:

the first member is configured to pivot about a first hinge axis when the pop-up structure is transitioned between the stowed configuration and the deployed configuration;

the second member is configured to pivot about a second hinge axis when the pop-up structure is transitioned between the stowed configuration and the deployed configuration; and the pop-up structure is configured to allow the second member to be selectively rotated relative to the support surface about a rotation axis that is transverse to the support surface.

2. The playset of claim 1, wherein the support surface includes a track, and at least a portion of the second member is movable along the track.

3. The playset of claim 2, wherein the track has an arcuate configuration that is centered on the rotation axis.

4. The playset of claim 1, wherein the pop-up structure is configured such that selectively rotating the second member such that the second hinge axis is oriented transversely to the first hinge axis when viewed in a plane containing the second axis precludes transitioning the pop-up structure between the deployed configuration and the stowed configuration.

5. The playset of claim 1, wherein at least one of the first and second members is normal to the support surface when the pop-up structure is in the deployed configuration.

6. The playset of claim 1, wherein the pop-up structure further comprises a third member hingedly coupled to the first member, the pop-up structure is configured to maintain the third member substantially parallel to the support surface, and the third member is spaced from the support surface when the pop-up structure is in the deployed configuration.

7. The playset of claim 6, wherein the pop-up structure further comprises a fourth member hingedly coupled to the second member, the fourth member is configured to pivot about a third hinge axis relative to the second member, the third hinge axis is parallel to the second hinge axis, and the fourth member is configured to rotate about the rotation axis when the second member is selectively rotated about the rotation axis.

8. The playset of claim 1, wherein the support surface includes first and second portions, and the first portion faces the second portion when the pop-up structure is in the stowed configuration.

9. A playset, comprising:

a shell having first and second shell members, the first shell member having a first interior surface, the second shell member having a second interior surface, the shell members being adapted to be transitioned between a closed configuration and an open configuration, where in the dosed configuration the first and second interior surfaces are facing each other, and in the open configuration the shell members are spaced apart;

at least one mount disposed on at least one of the first and second interior surfaces;

at least one projectile;

a projectile launcher, wherein the projectile launcher is configured to be retained by the at least one mount, and the projectile launcher is configured to receive, retain and selectively ballistically project the at least one projectile; and a pop-up structure that extends transversely from at least one of the first and second interior surfaces when the shell members are positioned in the open configuration, the pop-up structure including a plurality of elements adapted to be transitioned between a stowed configuration and an erect configuration when the shell members are transitioned between the closed configuration and the open configuration, where in the stowed configuration the plurality of elements are disposed between the shell members, and in the erect configuration the plurality of elements extend generally transversely from the at least one of the first and second interior surfaces.

10. The playset of claim 9, wherein the at least one mount is configured to selectively removably retain the projectile launcher.

11. The playset of claim 9, comprising at least one projectile retainer disposed on at least one of the first and second interior surfaces, wherein the at least one projectile retainer is configured to releasably retain the at least one projectile.

12. The playset of claim 9, wherein the pop-up structure includes at least one target element that is pivotable relative to the pop-up structure when the pop-up structure is in the erect configuration, and the projectile launcher is selectively aimable such that the projectile launcher is configured to project the at least one projectile toward the target element.

13. The playset of claim 12, wherein the target element is pivotable between a first position and a second position, and the target element is configured to transition from the first position toward the second position when the target element is struck by the at least one projectile while the target element is in the first position.

14. A playset, comprising:

a support surface;

a pop-up structure coupled to the support surface and adapted to be selectively transitioned between a stowed configuration and a deployed configuration, where in the stowed configuration the pop-up structure is collapsed and extends along the support surface, and in the deployed configuration the pop-up structure stands substantially transverse to the support surface, the pop-up structure comprising:

a first member hingedly coupled to the support surface, wherein the first member extends along the support surface when the pop-up structure is in the stowed configuration, and the first member extends transversely from the support surface when the pop-up structure is in the deployed configuration; and a second member hingedly coupled to the first member, wherein the second member includes a first surface, the first surface extends along the first member when the pop-up structure is in the stowed configuration, and the first surface is spaced from and parallel to the support surface when the pop-up structure is in the deployed configuration; and a movable platform coupled to the support surface independently of the pop-up structure and adapted to be selectively transitioned between a first position proximate the support surface and a second position spaced from the support surface, wherein the movable platform includes a second surface, in the first position at least a first portion of the second surface may be disposed proximate the support surface, and in the second position at least a second portion of the second surface may be disposed proximate the first surface.

15. The playset of claim 14, wherein the second member includes an edge and the movable platform includes a first end, and the edge of the second member is configured to at least partially support the first end of the movable platform when the movable platform is in the second position.

16. The playset of claim 15, wherein the second portion of the second surface is aligned with the first surface when the movable platform is in the second position.

17. The playset of claim 14, further comprising:

a third member having a first end and a second end opposite the first end, wherein the first end is pivotably coupled to the support surface, the third member is adapted to be selectively transitioned between a third position and a fourth position, in the third position the third member extends along the support surface, and in the fourth position the third member extends transversely from the support surface; and a fourth member pivotably coupled to the movable platform, wherein the fourth member is adapted to slide along the third member between a fifth position and a sixth position, where in the fifth position the fourth member is disposed proximate the first end of the third member, and in the sixth position the fourth member is disposed proximate the second end of the third member.

18. The playset of claim 14, wherein the third member is configured to support the movable platform in the second position when the third member is in the fourth position and the fourth member is in the sixth position.

19. The playset of claim 18, wherein the first and second surfaces form a substantially continuous surface when the third member supports the movable platform in the second position.

20. The playset of claim 14, wherein the first and second surfaces are planar and the first and second surfaces are substantially coplanar when the movable platform is in the second position.

21. The playset of claim 14, wherein the movable platform is coupled to the support surface in a manner allowing the platform to be maintained parallel to the support surface while the platform is transitioned between the first and second positions.

* * * * *